US009592524B2

(12) United States Patent
Fritz et al.

(10) Patent No.: US 9,592,524 B2
(45) Date of Patent: Mar. 14, 2017

(54) COATING DEVICE COMPRISING A JET OF COATING MEDIUM WHICH IS BROKEN DOWN INTO DROPS

(75) Inventors: Hans-Georg Fritz, Ostfildern (DE); Marcus Kleiner, Besigheim (DE); Timo Beyl, Besigheim (DE)

(73) Assignee: Duerr Systems GmbH, Bietigheim-Bissingen (DE)

( * ) Notice: Subject to any disclaimer, the term of this patent is extended or adjusted under 35 U.S.C. 154(b) by 1040 days.

(21) Appl. No.: 13/696,232

(22) PCT Filed: May 6, 2011

(86) PCT No.: PCT/EP2011/002265

§ 371 (c)(1), (2), (4) Date: Jul. 19, 2013

(87) PCT Pub. No.: WO2011/138048

PCT Pub. Date: Nov. 10, 2011

(65) Prior Publication Data

US 2013/0284833 A1 Oct. 31, 2013

(30) Foreign Application Priority Data

May 6, 2010 (DE) ..... 10 2010 019 612

(51) Int. Cl.
*B05B 17/06* (2006.01)
*B05B 1/02* (2006.01)
(Continued)

(52) U.S. Cl.
CPC ..... *B05B 17/0653* (2013.01); *B05B 1/02* (2013.01); *B05B 1/18* (2013.01); *B05B 7/066* (2013.01);
(Continued)

(58) Field of Classification Search
CPC . B05B 17/06; B05B 17/0607; B05B 17/0676; B05B 1/02; B05B 1/14;
(Continued)

(56) References Cited

U.S. PATENT DOCUMENTS 6,508,196 B1 * 1/2003 Hansson ..... B05B 17/06 118/300
7,384,670 B2 * 6/2008 Tani ..... B05B 3/1014 239/1
(Continued)

FOREIGN PATENT DOCUMENTS

DE 30 3573 4/1953
DE 911109 5/1954
(Continued)

OTHER PUBLICATIONS

Brenn et al., "Control of Spray Formation by Vibrational Excitation of Flat-Fan and Conical Liquid Sheets", Atomization and Sprays, vol. 15, (2005) 661-685.
(Continued)

*Primary Examiner* — Christopher Kim
(74) *Attorney, Agent, or Firm* — Bejin Bieneman PLC

(57) ABSTRACT

A coating device comprises at least one application apparatus to discharge a coating agent from at least one coating agent nozzle. The application apparatus is configured to apply an oscillation to at least one of the coating agent and at least one coating agent jet such that at least one of the coating agent and the at least one coating agent jet break up into droplets.

17 Claims, 18 Drawing Sheets

(51) Int. Cl.

| | |
|---|---|
| ***B05B 1/18*** | (2006.01) |
| ***B05B 7/06*** | (2006.01) |
| ***B05B 7/08*** | (2006.01) |
| ***B05B 13/04*** | (2006.01) |
| *B05B 5/043* | (2006.01) |
| *B05B 5/10* | (2006.01) |
| *B05B 12/14* | (2006.01) |
| *B05B 15/12* | (2006.01) |
| *B05D 1/02* | (2006.01) |
| *B05D 7/14* | (2006.01) |

(52) U.S. Cl.
CPC ..... *B05B 7/0815* (2013.01); *B05B 12/149* (2013.01); *B05B 13/0431* (2013.01); *B05B 13/0452* (2013.01); *B05B 17/0607* (2013.01); *B05B 5/043* (2013.01); *B05B 5/10* (2013.01); *B05B 12/1418* (2013.01); *B05B 15/1225* (2013.01); *B05D 1/02* (2013.01); *B05D 7/14* (2013.01)

(58) Field of Classification Search
CPC B05B 1/18; B05B 5/025; B05B 5/043; B05B 5/08; B05B 5/10; B05B 7/06; B05B 7/062; B05B 7/066; B05B 7/08; B05B 7/0807; B05B 7/0815; B05B 12/14; B05B 12/1418; B05B 12/149; B05B 13/04; B05B 13/0431; B05B 13/0447; B05B 13/0452; B05B 15/1225; B05B 17/04; B05B 17/0653
USPC ..... 239/102.2
See application file for complete search history.

(56) References Cited

U.S. PATENT DOCUMENTS 7,988,068 B2 * 8/2011 Mita ..... B41J 2/04528 239/102.1
2005/0136190 A1 6/2005 Tani et al.
2006/0289672 A1 * 12/2006 Mita ..... B41J 2/04528 239/101

FOREIGN PATENT DOCUMENTS

| | | | |
|---|---|---|---|
| DE | 3713156 | A1 | 10/1987 |
| DE | 44 41 553 | A1 | 6/1995 |
| DE | 19809152 | A1 | 9/1999 |
| DE | 20005997 | U1 | 10/2000 |
| DE | 10317919 | A1 | 11/2004 |
| DE | 10327431 | A1 | 1/2005 |
| DE | 10 2006 012 389 | A1 | 9/2007 |
| DE | 10 2007 006 547 | | 8/2008 |
| DE | 102006058562 | A1 | 8/2008 |
| DE | 10 2008 015 258 | A1 | 9/2009 |
| EP | 1 331 037 | A2 | 7/2003 |
| EP | 1 764 157 | A2 | 3/2007 |
| JP | 63-093373 | | 4/1988 |
| JP | 09-024304 | | 1/1997 |
| JP | 2000-061362 | | 2/2000 |
| JP | 2002-282744 | | 10/2002 |
| WO | WO 2008/061584 | A1 | 5/2008 |
| WO | WO 2008/068005 | A1 | 6/2008 |
| WO | WO 2008/095657 | A1 | 8/2008 |
| WO | WO 2009/149950 | A1 | 12/2009 |
| WO | WO2010046064 | A1 | 4/2010 |

OTHER PUBLICATIONS

Brenn, et al., "Methods and Tools for Advanced Fuel Spray Production and Investigation" Atomization and Sprays, vol. 7 (1997) 43-75.
Domnick, et al. "Oversprayarme Spritzlackiertechnik", Metalloberfläche , vol. 51 (1997) 43-45 [Abstract in English].
European Patent Office, International Search Report, PCT/EP2011/002265, Aug. 5, 2011, 6 pages (with English Translation).

* cited by examiner

COATING DEVICE COMPRISING A JET OF COATING MEDIUM WHICH IS BROKEN DOWN INTO DROPS

FIG. 1 shows a cross-section view through a conventional painting installation for painting motor vehicle body parts. Here, the motor vehicle body components to be painted are transported on a conveyor 1 at right angles to the drawing plane through a painting cabin 2, in which the motor vehicle body components are then painted in a conventional manner by painting robots 3, 4. The painting robots 3, 4 have several rotating robot arms each of which carry, via a multi-axis robot hand axle, an application device, such as, for example, a rotary atomizer, an air atomizer, or a so-called airless device.

A drawback of these known application devices or application methods is the non-optimal degree of application efficiency, whereby a portion of the sprayed paint, known as overspray, does not land on the motor vehicle body component to be painted and has to be removed from the painting cabin 2 with the cabin air. Above the painting cabin 2 there is therefore a so-called plenum 5 from which air is introduced through a ceiling 6 of the painting cabin 2 downwards in the direction of the arrow into the painting cabin 2. The cabin air with the contained overspray then enters a wash-out 7 located under the painting cabin 2 in which the overspray is removed from the cabin air and bonded to water.

This waste water containing the overspray must then be treated again in a laborious process wherein the produced paint sludge constitutes special waste which must be disposed of in a correspondingly costly manner.

Furthermore, the air downdraft speed in the painting cabin 2 must be in the range of approx. 0.2-0.5 m/s at least in order to rapidly remove the overspray occurring during painting from the painting cabin 2.

One process seeks to replace washing out with water by dry separation. In this process, the dirty air is passed, for example, through swirled-up rock meal and suctioned through filters. A great deal of waste is also produced in this process.

In addition, the overspray occurring during painting can, at times and locally, produce an explosive atmosphere so that relevant statutory ATEX-product guidelines (ATEX: atmosphere explosible) must be observed.

On the one hand, due to their unsatisfactory application efficiency and the resulting overspray, the known application apparatuses incur high investment costs for the necessary wash-out and require explosion protection.

On the other hand, due to the overspray occurring during operation, the known application apparatuses are associated with high operating costs through the paint losses and the costs of disposing of the overspray. Furthermore, use of a large amount of paint also means high loading or a threat to the environment.

Concerning the prior art one is further referred to DE 911 109 B, DE-Zeitschrift: mo 51 (1997) Heft 1, Low overspray spray painting technology, p. 43 to 45, DE 200 05 997 U1, DE 10 2008 015 258 A1, DE 103 27 431 A1, DE Sch 30 3573 AZ and WO 2010/046064 A1.

A coating device may be provided for coating components with a coating agent, more particularly for painting motor vehicle body parts and/or attachment components of motor vehicles (e.g. bumpers, mirror housings, bumping strips etc.), but also other vehicles or vehicle parts, with a paint. The coating device comprises at least one application apparatus which is configured and arranged to discharge the coating agent out of at least one nozzle or coating agent opening (e.g. to apply, discharge, etc.).

The application apparatus can, for example, in particular be configured and arranged to apply an oscillation and/or an instability to the coating agent and/or at least one coating agent jet in order to generate coating agent droplets or to allow the coating agent and/or the at least one coating agent jet to break up into droplets. It is possible that the at least one coating agent jet is generated with a different characteristic.

For one exemplary embodiment the application apparatus can be configured and arranged in order to apply an oscillation or an instability to the coating agent and/or at least one preferably coherent or continuous coating agent jet in order to generate coating agent droplets or for the coating agent being discharged (in particular from the coating agent nozzle and/or the application apparatus) and/or a preferably coherent or continuous coating agent jet being discharged (in particular from the coating agent nozzle and/or the application apparatus) to break up into droplets. In this way it is possible that the coating agent jet during and/or before discharge from the coating agent nozzle or the application apparatus is continuous and breaks up into droplets on the way to the component (in particular downstream of the coating agent nozzle or the application apparatus).

The application apparatus can therefore be configured and arranged to discharge at least one coherent or continuous coating agent jet which breaks up into droplets. The coherent coating agent jet can, in particular, break up or form droplets here between the application apparatus, in particular the at least one coating agent nozzle, and the component.

The application apparatus may comprise an oscillation and/or instability and/or vibration generator (hereinafter referred to as an oscillation generator). Furthermore, the application apparatus can comprise a slit and/or hollow cylinder nozzle or a conical nozzle or a carrier element (e.g. a coating agent nozzle plate) which comprises a plurality of coating agent nozzles (preferably on one level). The application apparatus may be configured and arranged in order to have one or more coating agent columns behind or downstream of the at least one coating agent nozzle.

The oscillation generator may generate the oscillation and/or the instability or may couple the oscillation and/or the instability into the coating agent and/or the coating agent jet, in order to generate coating agent droplets and/or to allow the coating agent or the preferably continuous coating agent jet to break up into droplets. It is possible that the the oscillation and/or the instability is applied to the coating agent or the coating agent jet directly and/or indirectly. In one embodiment the oscillation generator may apply an oscillation and/or an instability at least partially to the application apparatus (for example the housing of the application apparatus, the carrier element having at least one coating agent nozzle or other parts of the application apparatus) or to couple them therein. In particular, application of an oscillation and/or an instability to the coating agent can occur before discharge of the coating agent and/or at the coating agent nozzle, while the break up into droplets can preferably take place after discharge of the coating agent out of the coating agent nozzle.

As previously mentioned the application apparatus is in particular configured and arranged in order for the coating agent and/or a coherent coating agent jet to break up into droplets or to form droplets, e.g., based on the so-called "Rayleigh instability" or the so-called "Rayleigh disintegration". The structure, the principle and/or the functionality of such droplet generation is known from the field of internal combustion engines where fuel can, for example, be applied with an oscillation to create a fuel-air mixture and be stimulated to perform mono-dispersal disintegration. It was a surprising and unexpected discovery that also an increased application efficiency can be achieved in this way during painting of motor vehicle body components.

The application apparatus can advantageously generate droplets of substantially the same size (for example of substantially the same diameter) and/or a substantially discrete or substantially homogeneous droplet distribution. It can also be advantageous to generate a droplet size distribution with certain (discrete) droplet sizes, in particular in a predefined manner. Here it is possible that the proportions of the individual droplet sizes in the mixture are different in a predefined manner (e.g. 50% 30 μm; 25% each of 20 μm and 40 μm). The application apparatus is advantageously capable of generating a predefined droplet size and/or a predefined droplet or droplet size distribution.

In conventional rotary atomizers the paint is atomized due to shearing forces on the edge of the bell cup; for an air atomizer it is due to the kinetic energy of the air. The airless principle is based on atomization of the paint by the material pressure. Here the paint is pressurized and atomized at a nozzle. In this way conventional atomizers for coating motor vehicle body parts usually generate a wide distribution of different droplet sizes. These usually range from a few μm up to 150 μm. The average value (d50) usually lies between 10 to 40 μm. Smaller droplets are more easily carried out by the cabin air into the separation system. Larger droplets are detrimental to the appearance (for example running, metallic effect, failure) and can even lead to surface defects (dips, craters etc.). Droplets which have a 20-40 μm diameter are also easier to apply an electrostatic charge to than smaller or larger droplets.

Using a coating device it is possible, for example, to create a painting installation, preferably for series painting of automobile and/or motor vehicle body components, which operates preferably without washing out and with a smaller feed air plant. The application efficiency can be increased through targeted generation of certain droplet diameters which means that it is possible that no overspray or only very little is generated, wherein it is possible to influence color tone and gloss in a targeted manner. Using a coating device according to the invention it is advantageously possible that the feed air plant can be very much smaller. The smaller amount of paint to be applied requires lower air volumes to be replaced in the painting cabin or a much larger quantity of recirculated air can be used (a lower proportion of fresh air used), whereby heating or conditioning of the suctioned in air consumes much less energy. Furthermore, it is possible, for washing out to be limited or dispensed with altogether.

Simple, relatively cheap filters can be used to isolate the low overspray. The plant engineering required is a lot simpler and this lowers the maintenance costs. It is also possible to save a large amount of paint in this way.

One can dispense with application of the ATEX guidelines dependent on the paints/coating agents used (water-based, solvent containing, etc.). This leads to significant simplification of selection of the components used and therefore to significant cost advantages compared to the conventional processes.

Furthermore, the coating device advantageously leads to the situation whereby the painting cabins, conveyors, skid, discs etc. require less (manual) cleaning. Furthermore, less or even no quantities of air are required to carry overspray out of the painting cabin and/or to form the spray jet and to drive the air turbine of the rotary atomizer in the processes mentioned (e.g. rotary atomizer, air atomizer).

Color matching with rotary atomizers on air models primarily takes place through targeted alteration of the droplet spectrum, for example, by altering the rotational speed. These changes usually have a negative effect on the application efficiency which leads to a situation where more overspray than is actually necessary occurs, which can also be prevented by the coating device.

The application apparatus is configured and arranged in order to discharge coating agent, e.g., a coherent coating agent jet. The coating agent, e.g., the coating agent jet such as the discharged coating agent jet, can, for example, be a full or fully cylindrical jet, a planar jet, a fan jet, a layered jet, an essentially triangular jet, a hollow cone jet or a full cone jet, a hollow cylindrical jet, a coating agent sheet and/or a coating agent lamella. It is also possible that the application apparatus generates a spray pattern which is essentially rectangular or pyramid-shaped in section. Therefore the coating agent, e.g., the coating agent jet, can therefore essentially be discharged as a single dimensional and also essentially planar jet.

The application apparatus can be configured and arranged to discharge at least an essentially flat coherent coating agent jet which breaks up between the coating agent nozzle or application apparatus and component initially into essentially single dimensional, preferably coherent coating agent jets. These single dimensional, preferably coherent, coating agent jets can also break up between the coating agent nozzle or application apparatus and component into droplets.

The application apparatus can be configured and arranged to indirectly apply or couple in the oscillation and/or the instability to the coating agent and/or the coating agent jet, for example via the housing of the application apparatus and/or via the carrier element having a coating agent nozzle and/or via the coating agent nozzle. For this purpose it is possible, for example, for an oscillation generator, oscillator, etc. to be connected or attached, preferably on the outside, to the application apparatus housing and/or the carrier element with the coating agent nozzle. It is therefore possible, for indirect application, the oscillation and/or the instability propagates from the oscillation generator via other parts of the application apparatus to the coating agent and/or to the coating agent jet. It is also possible that the applied oscillation and/or the instability propagates axially and/or radially along the application apparatus.

It is, however, also possible that the application apparatus is configured and arranged for essentially direct coupling of the oscillation and/or the instability into the coating agent and/or the coating agent jet, for example by means of sound, ultrasound, a piezo element, direct mechanical or physical application, for example physical contacting the coating agent and/or the coating agent jet. For this purpose the application apparatus can, for example, include a sound/ultrasound generator, a piezo-element arrangement, a mechanical coating agent impact device, etc.

The coating agent and/or the coating agent jet can be essentially continuous ("essentially" because, for example, the main needle closes occasionally) conveyed by the coating agent nozzle and/or discharged from the coating agent nozzle. The coating agent and/or the coating agent jet may be conveyed by pressure or by a dosing system.

The application apparatus may be configured and arranged in order to form droplets of essentially the same size and/or of essentially the same diameter and in order to form an essentially discrete or essentially homogeneous droplet distribution. It is possible, in particular, to form droplets with droplet diameters of greater than about 10 μm, 30 μm, 50 μm, 70 μm, 90 μm, 110 μm, 130 μm or 150 μm and/or smaller than about 20 μm, 40 μm, 60 μm, 80 μm, 100 μm, 120 μm, 140 μm or 160 μm.

It is possible that the at least one coating agent nozzle is essentially circular (e.g. a round nozzle), elliptical, slit-shaped and/or essentially in the form of a circular slit. The coating agent nozzle can, for example, comprise a planar jet, a hollow cone jet, a full cone jet or a full jet nozzle or a cone nozzle.

The application apparatus may include a plurality of coating agent nozzles which can be all the same or different, as, for example, concerns the diameter, the slit width, the form or the formation of the nozzles, etc. It is preferable that the coating agent nozzle has a diameter and/or a slit width of between about 5 μm to 300 μm, between about 10 μm to 150 μm or between about 10 μm to 80 μm.

The differently sized coating agent nozzles can, for example, be evenly distributed or grouped together in certain areas or forms.

The application apparatus can, at least, comprise a coating agent nozzle arrangement (or a nozzle array, row of nozzles, etc.), on which a plurality of coating agent nozzles is arranged. It is possible that a coating agent nozzle arrangement has coating agent nozzles with the same or a different formation.

It is, however, possible that the application apparatus comprises at least two coating agent nozzle arrangements, each with a plurality of coating agent nozzles. At least two coating agent nozzle arrangements may be provided that can be actuated independently of one another and/or that can be supplied, for example, with a different coating agent or generally different media or fluids, independently of one another. Thus the one coating agent nozzle arrangement can, for example, be supplied with a particular colour, a particular paint or generally a particular coating agent, whereas the other coating agent nozzle arrangement can, for example, be supplied with a different colour, a different paint or in general a different coating agent. Furthermore, at least two coating agent nozzle arrangements can be provided in different levels which can be arranged, for example, in parallel or transverse. It is possible that at least two coating agent nozzle arrangements have a form which is essentially complementary to the component in order to allow the component to be coated without re-orientation of the application apparatus. Furthermore, the at least two coating agent nozzle arrangements can be rotatable relative to one another in one or more axes, which advantageously leads to greater flexibility. It is also possible that the application apparatus comprises at least two coating agent nozzle arrangements which can be actuated independently of one another and/or which can be supplied with a coating agent dependently of one another, wherein it is also possible that at least two coating agent nozzle arrangements are provided which can be actuated dependently of one another and/or which can be supplied with a coating agent independently of one another.

The application apparatus can, furthermore, comprise at least two, or in some cases at least three, coating agent nozzle arrangements which can be actuated or adjusted (for example controllable or variable) independently of one another coating agent nozzle arrangements, wherein, for example, the outer coating agent nozzle arrangements are configured and arranged to form an overlapping-optimized layer thickness distribution and the inner coating agent nozzle arrangement is configured and arranged to form an essentially homogeneous layer thickness distribution, for example in that the outer coating agent nozzles discharge less coating agent than the inner coating agent nozzles, which leads to an appropriate layer thickness distribution transverse to the path direction. It is also possible that the coating agent nozzles of at least one coating agent nozzle arrangement are arranged in such a way (for example in an essentially Gaussian curve form or distributed over the surface under Gaussian curve, trapezoid-shaped, rectangular and/or triangular), that a desired layer thickness distribution is achieved, wherein, for example, the outer coating agent nozzle arrangements are configured and arranged to form an overlapping-optimized layer thickness distribution (for example triangular) and the inner coating agent nozzles (for example rectangular) is configured and arranged to form an essentially homogeneous layer thickness distribution, wherein it is advantageously made possible, in a simple way, that the outer coating agent nozzles discharge less coating agent than the inner coating agent nozzles. It is possible for the layer thickness distribution to be a Gaussian normal distribution. Alternatively it is possible for the coating agent quantity discharged by the individual coating agent nozzles to be selected so that the layer thickness distribution has a trapezoidal distribution. Such a trapezoidal layer thickness distribution is advantageous since the adjacent coating agent paths can overlap each other in such a way that the superimposition of the trapezoidal layer thickness distributions of the adjacent coating agent paths results in a constant layer thickness. It is furthermore possible that, for example, one or more coating agent nozzle arrangements, in particular an outer coating agent nozzle arrangement, can be switched on and/or off, for example, to allow sharp-edged coating. It is also possible that a preferably outer coating agent nozzle arrangement is fed less coating agent than another coating agent nozzle arrangement.

It is advantageous, therefore, that the application apparatus can both switch off one of the preferably outer fields and perform sharp-edged coating, and also overlap on a large surface with the previous and the following paint path.

It is possible that the coating agent pressure and/or the dosing pressure at which the coating agent is fed to the application apparatus and/or the component is adjustable (for example controllable or variable), wherein it is advantageous, for example, that the size of the coating agent droplets can be influenced.

This can be done in a targeted manner to obtain certain properties of the paint film (for example appearance, moisture content). The paint pressure can be altered and regulated using suitably assigned components. The change can be dependent of the applied coating agent (for example various paints or color tones). It can also be different on the one and the same component at different locations. In this way it is possible, for example, to paint "wet" or "dry".

At least one of the following parameters can be adjusted (for example controllable or variable): discharge or output speed of the coating agent, painting clearance between the coating agent nozzle and the component, coating agent pressure and/or the dosing pressure, magnitude or strength of the oscillation and/or instability, in particular the amplitude of the oscillation and/or the instability, frequency of the oscillation and/or the instability, for example in order to be able to control or regulate the droplet size and/or the droplet creation or the droplet distribution. In this way an improved appearance, an improved color tone, improved effects and/or an improved performance (degree of gloss, wave length etc.) is achievable, because the droplet size can optimally be varied as required in a manner specific to the coating agent and/or specific to the component. It is furthermore advantageous here that the droplet size and/or the droplet distribution can be controlled or regulated, even though every individual coating agent nozzle has a constant diameter.

The application apparatus may be configured and arranged in such a way that the coating agent droplets of a coating agent jet do not coalesce on their way to the component or between the coating agent nozzle and the component. It is furthermore possible, on their way to the component, that the coating agent (or the coating agent droplets) from one coating agent nozzle do not coalesce with the coating agent (or the coating agent droplets) from another coating agent nozzle or the coating agent droplets from a first coating agent jet do not coalesce with the coating agent droplet from a second coating agent jet. This can be, for example, be achieved in that the discharge speed of the coating agent droplets, the size of the coating agent droplets, the distance between the coating agent nozzles to each other and/or the painting clearance between the coating agent nozzle and the component are coordinated with each other. It is, in particular, possible that a liquid sheet or liquid lamella (for example formed by a slit nozzle or a hollow cylinder nozzle) breaks up into coating agent droplets under the influence of the oscillation, wherein the coating agent droplets do not coalesce on their way to the component.

The coating agent nozzle and/or the coating agent nozzle arrangement may be arranged on a carrier element (for example a coating agent nozzles plate) or an applicator head. The carrier element may be fastened exchangeably to the application apparatus by means of a quick-change device. In this way it is possible, for example, to use a carrier element for smaller painting surfaces (for example door entrance edges) as well as a carrier element for larger painting surfaces within a "cycle," which is particularly advantageous if the coating device is used in a plant designed according to the box concept. The carrier element can be designed in different ways. However, it is preferred that the carrier element is configured and arranged in such a way that the oscillation and/or the instability can essentially be evenly transmitted to the carrier element. The carrier element can, for example, be designed plate-shaped and/or faceplate shaped, but can also have other forms.

It is possible that the oscillation and/or the instability runs in the form of a standing wave from the oscillation generator to the carrier element.

The application apparatus may be configured and arranged to generate different oscillations and/or instabilities in an adjustable manner (for example controllable or variable). It is therefore possible that, for example, different oscillations and/or instabilities are generated adapted in different ways dependent on the coating agent, dependent on the respective component or also dependent on different sections of the component to be coated.

The application apparatus can, furthermore, be designed and arranged in such a way that it can, for example, be adapted for a different number of coating agent nozzles or for different product parameters (flow speed, throughput quantity, viscosity, surface tension).

It is possible that a multi-axis coating robot (for example including a wrist), a roof machine and/or a side machine is configured and arranged in order to move the application apparatus relative to the component. It is also possible that a multi-axis coating robot (for example including a wrist) and/or a conveyor path is configured and arranged in order to move the application apparatus relative to the component. It is also possible that both the component and the application apparatus are moved relative to one another during the coating operation, the former, for example, by means of the handling robot, the latter, for example, by means of the coating robot. It is also possible that the application apparatus is mounted rotatable about one or more rotational axes and can rotate around the one or more rotational axes during the coating or between consecutive coating operations.

The coating device can comprise at least one of the following components and/or the application apparatus can be operatively connected or connectable with at least one of the following components: at least one dosing pump, at least one dosing piston, at least one colour changer (for example a docking colour changer) and/or at least one mixer for two or multi-component paints (paint and hardener components or generally different coating agents). The at least one colour changer can be housed in the application apparatus (for example as an Integrated Colour Changer) or placed upstream of the application apparatus preferably as a separate part.

At least one cladding flow nozzle may be provided to discharge a cladding flow consisting of air or another gas with which the discharged coating agent can be cladded. It is also possible to make available at least one guiding flow nozzle which is provided to discharge a guiding flow consisting of air or another gas in order to form the discharged coating agent. It is furthermore possible for at least one function opening or function nozzle to be made available to discharge an air or fluid flow or another medium, for example in order to influence the discharged coating agent, preferably to dry it and/or to heat it. It is, however, also possible that the gas discharged out of the cladding flow or guiding flow nozzle is used for warming and/or drying.

The application apparatus can, for example, have a plurality of cladding flow/function and/or guiding air flow nozzles which can extend along at least one, preferably all sides of one or more coating agent nozzles or coating agent nozzle arrangements in order to influence the discharged coating agent. In doing so the cladding flow/function and/or guiding air flow nozzles can be aligned to be essentially in one line. The application apparatus can, in particular, have a plurality of cladding flow/function and/or guiding air flow nozzles which are arranged in one or more rings or part rings around the one or more coating agent nozzles or coating agent nozzle arrangements. The rings or part rings can have different or essentially the same diameter.

It is, in particular, possible to design and/or arrange and/or operate the cladding flow/function and/or guiding air flow nozzles on the application apparatus according to the invention as disclosed in the documents DE 10 2007 006 547, EP 1 331 037 A2, WO 2008/061584 A1, EP 1 764 157 A2, WO 2008/068005 A1, WO 2008/095657 A1 and/or WO 2009/149950 A1, the complete disclosures for which should be added to this disclosure, and accordingly are hereby incorporated herein by reference in their entireties.

It is possible that the application apparatus comprises a plurality of oscillation generators, for example a first oscillation generator which is configured and arranged in order to apply an oscillation to the coating agent for at least one coating agent nozzle and/or coating agent nozzle arrangement, and another second oscillation generator which is configured and arranged in order to apply an oscillation to the coating agent for at least one other coating agent nozzle and/or coating agent nozzle arrangement. This can, for example, be necessary when a paint base and metallic flakes are used for coating. To do this the paint base can be separated, for example, from the metallic flakes in the application apparatus using a disk filter. In doing so the paint base without flakes may be applied via coating agent nozzles with a smaller diameter and the metallic flakes via coating agent nozzles with a larger diameter (dimensioned in such a way that the metallic flakes pass through) which is not, however, absolutely necessary since one should only, in particular, ensure that the flake concentration is higher in the covering layer. In doing so the application parameters may be selected in a known way such that the flakes primarily align themselves parallel to the surface and/or create a good flop.

The diameter of the coating agent nozzle provided to apply flakes or other solid paint particles may be selected in such a way that the flakes or the other solid paint particles can be securely, or in a manner appropriate to the function, led through the coating agent nozzle. The diameter of the coating agent nozzle may be at least as large as the maximum flake diameter of a metallic basic paint, in particular twice or even three times the size of the maximum flake diameter or the maximum diameter of the solid paint particles.

The coating agent can be a paint, in particular a basic paint, a clear paint, an effect paint, a mica paint, a metallic paint, a water-based paint, a solvent-based paint and/or a two or multi-component paint. For example, the coating agent is a paint which is liquid and which contains solid paint particles, in particular pigments, metallic flakes or metal particles. In doing so it is, in particular, necessary that the coating agent nozzle is dimensioned in such a way that the paint can, in particular, be applied with the solid paint particles in it. The solid paint particles can have a particle size greater than approx. 4 μm, 5 μm or 6 μm.

The application apparatus can have a surface coating performance of at least 1 $m^2$/min, 2 $m^2$/min, 3 $m^2$/min or 4 $m^2$/min or 5 $m^2$/min and/or can preferably apply a coating agent layer thickness of at least 3 μm, 8 μm, 15 μm, 25 μm, 50 μm, 75 μm, 100 μm or more (a basic paint and primer are, for example, applied up to about 25 μm whereas, for example, a clear paint is usually applied up to about 50 μm).

It is furthermore possible that the application apparatus can achieve a coating agent discharge of at least 50 ml/min, 100 ml/min, 150 ml/min, 200 ml/min, 300 ml/min, 400 ml/min or 500 ml/min up to 1000 ml/min, up to 1500 ml/min or even more.

At least one colour changer (or a plurality of colour changers) can be assigned to the application apparatus which is connected on the outlet side to the application apparatus and on the inlet side is supplied with various coating agents so that the colour changer can select one of the coating agents and can supply the application apparatus with the selected coating agent. It is furthermore possible that the colour changer is supplied on the inlet side with various special paints or coating agents. It is also possible that the colour changer is connected on the inlet side with a mixer in order to be supplied with the coating agent (e.g. two or multi-component paints). A return line can branch off between the colour changer and the application apparatus. It is also possible that the colour changer is connected on the outlet side with a mixer.

The application apparatus can have a plurality of coating agent nozzles which are arranged in one or more rows of nozzles, e.g., in the form of a matrix in lines and columns. It is furthermore possible that the coating agent nozzles in the various rows of nozzles are commonly fed by a colour changer, wherein, for example, the colour changer is connected on the inlet side to a plurality of coating agent feed lines (for example special paint feed lines), through which coating agents (for example special paints) can be fed to the colour changer. The colour changer can, furthermore, be connected on the inlet side to a mixer, which can be fed with various coating agents (e.g. two or multi-component paint). In doing so the colour changer can select one of the coating agents from one of the coating agent feed lines or select the mixed coating agent from the mixer and feed it to the coating agent nozzles.

The application apparatus can have a multiplicity (the same or different) of coating agent nozzles which can be arranged in at least one, or in a plurality of rows of nozzles, in particular in the form of a matrix in lines and columns, wherein each row of nozzles can comprise a plurality of coating agent nozzles. The coating agent nozzles or the rows of nozzles can, for example, be arranged in an "alternating sequencing" or offset to each other so that the coating agent droplets overlap evenly on the component. Here it is possible that the coating agent nozzles of the various nozzle rows are commonly connected to a coating agent supply line via which the coating agent to be applied can be fed. It is furthermore possible that the common coating agent supply line is fed by a colour changer, also a docking colour changer (rotary or linear) and/or a mixer.

An application apparatus can be provided which can be fed directly by a colour changer and directly by a plurality of coating agent feed lines. It is also possible for a plurality of application apparatuses to be provided which are directly fed commonly by a plurality of coating agent feed lines and/or commonly by a colour changer. It is also possible that a plurality of application apparatuses and/or coating agent nozzle arrangements are provided which are fed by a plurality of separate coating agent feed lines, each of which is assigned to a colour changer. It is also possible to provide an application apparatus and/or a coating agent nozzle arrangement which is fed by a plurality of separate coating agent feed lines, each of which is assigned to a colour changer. It is furthermore possible that at least one application apparatus and/or one coating agent nozzle arrangement can be fed directly by at least one, or by a multiplicity, of coating agent feed lines each of which is preferably assigned to a dosing device (e.g. a dosing pump). Furthermore, the application apparatus can comprise an integrated changeover device in order to set which of the plurality of coating agent feed lines and/or which of the plurality of colour changers the coating agent is delivered from.

It is possible that the section of the surface coming into contact with the coating agent, in particular the inner sections of the surface of the application apparatus and/or the coating agent nozzles, can be coated, at least in part, with a wear-reducing, preferably abrasion-resistant coating, in particular with a DLC coating (DLC: Diamond-like Carbon), a diamond coating, a tungsten carbide or a material combination made out of a hard and a soft material, with a PVD coating (PVD: Physical Vapour Deposition), with an easy-to-clean coating, and/or with a streamlined structure, in particular a sharkskin structure or a ripplet or golf ball structure.

The coating device can, for example, comprise a system for electrostatic coating agent charging, e.g., using a high voltage, in particular for exterior charging by means of one or more external electrodes (e.g. a plurality of finger electrodes or an electrode ring, which comprises a plurality of electrodes, wherein the electrodes may be arranged evenly around the application apparatus) and/or for direct or interior charging by means of one or more contact or internal electrodes. The electrodes may be high voltage electrodes. The exterior charging and the interior charging are known from the prior art for rotary atomizers. The coating agent charging system is configured and arranged in order to achieve an improved separation and/or an improved coating agent yield and/or an improved application efficiency.

Furthermore, a compressed air support can be provided for improvement of the application efficiency of the application apparatus which can be adjustable (for example controllable or variable).

The coating agent nozzles can be of different sizes and/or formed differently, for example cylindrical or circular or rectangular, tapering in and/or widening, (e.g. conically) tapering in with an essentially constant outlet (for example a cylindrical outlet), (for example conically) widening with an essentially constant inlet (for example a cylindrical inlet) and/or as a Laval or Venturi nozzle. The coating agent nozzle can furthermore include one or more bulges or chambers which are connected together. Round nozzles or slit nozzles may be provided.

It is possible that the colour changer and/or the application apparatus, in particular parts (for example lines) which carry or contain the coating agent, can be applied with flushing agent/solvent and/or pulsed air for cleaning it. For this purpose the coating device can comprise a flushing agent/solvent line system and/or a pulsed air line system with appropriate valves.

The sections coming into contact with coating agent and/or the respective surfaces may be designed in such a way that, for example, a rapid change of paint or medium can be performed, wherein, for example, small volumes, smooth surfaces, no indentations, simple rinsing capability, etc. should be provided.

Filling and flushing can be accelerated by a bypass (ventilation opening, return line). This opening can additionally be connected to a vacuum source. It is therefore possible that the flushing agent/solvent and/or the pulsed air (preferably with dirt paint) is discharged out of the coating agent nozzle, or can be disposed of via a return line via another outlet or the one as well as the other, namely firstly the main quantity of the paint with solvent via the return line, then for the coating agent nozzle cleaning solvent/pulsed air, also via the coating agent nozzles.

The application apparatus can be connected to a plurality of, and maybe with all, known and used components in the painting field such as, for example, dosing pumps, dosing pistons, colour changers, docking colour changers, static mixers (for example for two or multi-component systems or generally coating agents), guide or cladding gas systems, single circuit and two-circuit systems with switch-over valves and, preferably, controllable via separate controllers, robots, etc.

It is furthermore possible to make available electrical isolation or isolation for the application apparatus, e.g., the oscillation generator.

It is furthermore possible that the coating device comprises a temperature control device to control the temperature of the coating agent and/or the flushing agent/solvent or also the guiding and/or cladding flow.

Further disclosed is a coating method for coating components with a coating agent, in particular for painting motor vehicle body components and/or attachment components thereof (e.g. bumpers, mirror housings, bumper strip etc.) but also other vehicles or vehicle parts with a paint, preferably with a coating device as described herein, wherein at least one application apparatus discharges the coating agent out of at least one coating agent nozzle (e.g. discharges, applies, etc.).

The application apparatus can, for example, apply an oscillation and/or instability to the coating agent and/or to at least one coating agent jet in order to generate coating agent droplets or to allow the coating agent and/or the at least one coating agent jet to break up into droplets.

The application apparatus can apply an oscillation and/or an instability to the coating agent and/or to at least one possibly continuous or coherent coating agent jet in order to create coating agent droplets or to allow discharged coating agent and/or a discharged possibly continuous or coherent coating agent jet to break up into droplets.

Further method steps arise directly from this disclosure of the coating device, e.g., from its operation.

It is possible that the oscillation and/or the instability is, for example, generated using a device such as that described in DE 10 2006 012 389 A1, in particular therefore by means of a concentric arrangement of at least two annular gap parts between which at least one annular gap is created and a drive equipment, with which at least one circumferential constriction is creatable on at least one annular gap. In doing so the drive equipment can, for example, include an oscillation source with which a gap oscillation can be generated on at least one of the annular gap parts in such a way that the constriction circulates on at least one annular gap. It is possible that a first annular gap is provided that is limited by a first and a second annular gap part, wherein the oscillation source is provided for excitation of the gap oscillation of at least one of the first and second annular gap parts. A second annular gap can preferably be provided which is limited by the second and a third annular gap part which surrounds the second annular gap part, wherein the oscillation source is provided for excitation of the gap oscillation of the second annular gap part. It is also possible that the second annular gap part has a channel in which the first annular gap part is arranged. It is also possible that the oscillation and/or the instability is, for example, generated using a device as described in DE 44 41 553 C2. DE 44 41 553 C2 discloses a device for forming droplets from a liquid traveling at the speed of sound c (for this invention preferably paint) under pre-pressure with a housing (for this invention preferably the housing of the application apparatus), through which the liquid can be guided from a liquid inlet to a liquid outlet and in which the liquid can be applied by means of suitable oscillation excitation with a frequency greater than a minimum frequency fMIN, wherein the oscillation of the liquid controls breaking up of the liquid into droplets at at least one outlet opening for the droplets on the liquid outlet and wherein an oscillation generator arranged outside the liquid is used to generate the oscillation whose vibrations can preferably be coupled in a larger distance than c/(2 fMIN) from the at least one outlet opening via the housing between the liquid inlet and the liquid outlet into the liquid, and wherein, furthermore, the inner part of the housing is designed in such a way that a laminar flow guidance occurs and transversal oscillation modes of the liquid are prevented. In the context of the present disclosure these techniques are used, however, for coating, in particular painting of vehicles, preferably motor vehicle bodies.

The coating device can comprise a plurality of application apparatuses.

The figures show as follows:

FIG. 1: a cross-section view through a conventional painting installation for painting motor vehicle body components.

FIG. 2: a cross-section view of a painting installation for painting motor vehicle body components with application apparatuses, FIG. 3A: an application apparatus with a colour changer and the associated coating agent supply, FIG. 3B: an application apparatus with at least two or more direct coating agent supply lines and a separate colour changer, FIG. 4A: a row of nozzles (part of a carrier element or a nozzle plate) with a plurality of coating agent nozzles and an assigned colour changer, FIG. 4B: a group of several, for example four, application apparatuses with at least two or more, for example four, direct coating agent supply lines and a separate colour changer, FIG. 5: a plurality of rows of nozzles for the application apparatus which are commonly supplied, with the coating agent to be applied, via a mixer with an attached colour changer and supply lines for a two or multi-component coating agent, FIG. 6: a plurality of rows of nozzles for the application apparatus which are commonly supplied via a single coating agent supply line to which a mixer with supply lines for a two or multi-component coating agent is assigned, FIG. 7: a nozzle arrangement in an application apparatus, FIG. 8: an alternative nozzle arrangement in the application apparatus with smaller coating agent nozzles, FIG. 9: an alternative arrangement of the coating agent nozzles in the application apparatus, wherein the coating agent nozzles have different nozzle sizes, FIG. 10: a variation of FIG. 9, wherein the nozzle rows with the larger coating agent nozzles are arranged offset with regard to each other FIG. 11: an application apparatus arrangement with a plurality of freely movable and/or rotatable application apparatuses for adaptation to curved component surfaces, FIG. 12: a schematic view of a coating device according to the invention with a multiple axis robot which guides an application apparatus and a sensor in order to position the application apparatus, FIG. 13: a schematic view of a coating device according to the invention in which several components are mixed to form a mixture, wherein the application apparatus then applies the mixture, FIG. 14: a schematic view of an application apparatus according to the invention with a cladding flow nozzle, FIG. 15: a schematic view of an application apparatus which generates a trapezoidal layer thickness distribution FIG. 16: a schematic view of a coating device according to the invention in which numerous application apparatuses are mounted on a portal, FIGS. 17 and 18: variations of FIGS. 9 and 10 with a maximum packing density of the individual nozzles, FIGS. 19A to 19E: various forms of longitudinal sections of coating agent nozzles, FIG. 20A: a schematic view of a nozzle arrangement for an application apparatus, FIG. 20B: a schematic view of a layer thickness distribution generated by the nozzle arrangement according to FIG. 20A, FIG. 20C: a schematic view of another nozzle arrangement for an application apparatus, FIG. 21A: a schematic view of yet another nozzle arrangement for an application apparatus, FIG. 21B: a schematic view of a layer thickness distribution generated by the nozzle arrangement according to FIG. 21A, FIG. 21C: three overlapping trapezoidal layer thickness distributions with the resulting overall layer thickness distribution similar to FIG. 15, FIG. 21D: a sharp-edged layer thickness distribution, generated by means of at least one switched off applicator or switched off coating agent nozzle arrangement, FIG. 22A: a schematic view of a break up into droplets of an initially coherent coating agent jet, discharged by an application apparatus, FIG. 22B: a schematic view of a prior art atomization;

FIG. 22C: a very simplified view of a break up into droplets of an initially coherent coating agent jet, discharged by an application apparatus, FIGS. 23A to 23E: schematic views of different coherent coating agent jets with their respective spray jet cross-section, FIGS. 24A, 25A, 26A: schematic views of different application apparatuses with a coating agent having no oscillation applied to it, FIGS. 24B, 25B, 26B: schematic views of different application apparatus with a coating agent having an oscillation applied to it, FIGS. 27A, 27B, 27C: schematic views of cross-sections of various application apparatuses, in particular in the area of the carrier element or the nozzle plate, FIG. 28: a very simplified application apparatus, FIG. 29: a multiplicity, for example three, application apparatuses with two coating agent supply lines separated from each other with a respective colour changer, FIG. 30: an application apparatus with two coating agent supply lines separated from each other with a respective apparatus changer, FIG. 31: an application apparatus with two coating agent supply lines and integrated switch-over device.

The cross-section view in FIG. 2 shows a painting installation that partially corresponds with the conventional painting installation shown in FIG. 1, so that, in order to avoid repetition, reference is made to the above description, wherein the same reference numerals are used for corresponding details.

A special feature of the painting installation disclosed herein is that the painting robots 3, 4 do not have rotary atomizers as application devices, but rather application apparatuses 8, 9, each of which comprises an oscillation generator SE and which can be designated as droplet generator or application head. The respective application apparatus 8, 9 has a much higher application efficiency, e.g., over 90% higher, than rotary atomizers. In this way it is possible that less overspray is created because the application apparatuses 8, 9 are capable of forming coating agent droplets, e.g., paint droplets with essentially an equal size and with an essentially discrete or homogeneous droplet distribution. The application apparatuses 8, 9 may apply and discharge the coating agent essentially continuously during a coating operation.

The application apparatuses 8, 9 with the oscillation generators SE apply an oscillation and/or an instability to the coating agent to form coating agent droplets and/or to allow the coating agent to break up into droplets. There are, in particular, initially coherent or continuous coating agent jets coming out of the coating agent nozzles or the application apparatuses 8, 9 which then break up into droplets on the way to the component or between the application apparatuses 8, 9 or the coating agent nozzles and the component.

Application or formation of droplets of essentially the same size and/or of an essentially homogeneous droplet distribution offers the advantage, on the one hand, that one can dispense with the washing out system 7 for the conventional painting installation according to FIG. 1.

Instead, the painting installation of FIG. 2 has an air extractor 10 under the painting cabin 2 which extracts the cabin air downwards from the painting cabin 2 through a filter ceiling 11. Here, the filter ceiling 11 filters the small amount of overspray out of the cabin air without the wash-out 7 being required as in the conventional painting installation. Items such as a cartridge filters, fleeces, filter mats, cardboard filters, etc. can be used as filter elements.

FIG. 3A shows an application apparatus 8 (9) which is supplied by a colour changer 13 with the coating agent to be applied. On the input side the colour changer 13 is connected to a plurality of coating agent supply lines (colour 1 to colour 7) from which the colour changer 13 can select one for supplying coating agent to the application apparatus 8 (9).

FIG. 3B shows an application apparatus 8 (9) which is directly supplied by at least two, for example three, coating agent supply lines (colour 5 to colour 7) with the coating agent to be applied (so-called "High-Runners") and a separate colour changer 13.

On the input side the colour changer 13 can, for example, be connected to four coating agent supply lines (colour 1 to colour 4) from which the colour changer 13 can select one for supplying coating agent to the application apparatus 8.

The coating agent supply lines may be directly connected for direct supply of the application apparatus 8 with the application apparatus 8, wherein, for example, every coating agent can be assigned to a separate dosing device (e.g. a dosing pump) which advantageously does not have to be flushed out.

FIG. 4A shows a group of coating agent nozzles 16.1-16.5, which are commonly connected to the outlet of a colour changer 17 and therefore apply the same coating agent during operation.

On the input side the colour changer 17 is connected to a multiplicity, for example, seven, coating agent supply lines. The five coating agent nozzles shown are an example of an arrangement of a plurality of coating agent nozzles.

FIG. 4B shows a modification of the exemplary embodiments in FIGS. 3B and 4A, so that reference is made to the above description to avoid repetition, wherein the same reference numerals are used for corresponding details.

FIG. 4B in particular shows a group of two or more, e.g., four, application apparatuses 8 with two or more, e.g., four, direct coating agent supply lines (colour 5 to colour 8) and a separate colour changer 17.

The respective application apparatuses 8 may be commonly connected to the outlet of the colour changer 17 and/or to the coating agent supply lines (for so-called "High-Runners") and therefore apply the same coating agent during operation.

FIG. 5 shows a further exemplary embodiment of a nozzle arrangement in the application apparatuses 8, 9, wherein several, e.g. four, nozzle rows 28.1-28.4 are shown here, each of which has numerous coating agent nozzles 29. Here, all the coating agent nozzles 29 and all the coating agent rows 28.1-28.4 are commonly supplied with the same coating agent from a mixer 31 and a colour changer 30.

On the input side the colour changer 30 is connected with a plurality of coating agents (for example paints or special paints S1 to S3) or a plurality of coating agent supply lines and the mixer 31. The mixer 31 is connected on the input side with a plurality of coating agents, e.g., at least two components (K1, K2) for a two or multi-component paint (for example basic paint and hardener).

The example embodiment as shown in FIG. 6 partially corresponds with the above-described exemplary embodiment illustrated in FIG. 5, so that reference is made to the above description to avoid repetition, the same reference numerals being used for corresponding details.

A feature of this exemplary embodiment is that all coating agent nozzles 29 in all rows of nozzles 28.1-28.4 are connected with a common coating agent supply line 31 via which the same coating agent is fed and to which a mixer with feed lines (not shown in FIG. 6) for a first component and at least one second component is assigned (for example basic paint and hardener).

FIG. 7 shows a nozzle arrangement 34 for the application apparatuses 8, 9 of the painting installation according to the invention, wherein the arrow indicates the direction of advance of the application apparatuses 8, 9, i.e. the direction of the pressure.

From the drawing, it can be seen that the nozzle arrangement 34 has several nozzle rows 35.1-35.7 each of which comprise several coating agent nozzles 36.

Within the entire nozzle arrangement 34 the coating agent nozzles 36 here have a nozzle opening of uniform size.

The adjacent nozzle rows 35.1-35.7 are offset with regard to each other in the longitudinal direction by half the width of a nozzle, which allows a maximum packing density of the coating agent nozzles 36 within the nozzle arrangement 34.

FIG. 8 shows a derivation of a nozzle arrangement 34 which corresponds to a great extent with the nozzle arrangement described above and shown in FIG. 7, so that to avoid repetition reference is made to the above description.

A feature of this exemplary embodiment is that the individual nozzles 36 have a substantially smaller nozzle size.

A further feature of this exemplary embodiment is that the adjacent nozzle rows are not offset with regard to each other.

FIG. 9 shows a further exemplary embodiment of a nozzle arrangement 37 with five parallel nozzle rows 38.1-38.5 with relative large nozzle openings and four nozzle rows 39.1-39.4 with relatively small nozzle openings.

The exemplary embodiment in accordance with FIG. 10 largely corresponds with the exemplary embodiment in accordance with FIG. 9 described above, so that to avoid repetition reference is made to the above description, wherein the same reference numerals being used for corresponding details.

A feature of this exemplary embodiment is that the nozzle rows 38.1-38.5 with the larger nozzle openings are offset with regard to each other in the longitudinal direction by half the width of a nozzle.

FIG. 11 shows an application apparatus arrangement 46 with a total of four application apparatuses 47-50 which are rotatable with regard to each other or aligned appropriately to the surface of a, for example, curved component in order to allow better adaptation to the surface of a e.g. curved component 51.

In a very simplified form FIG. 12 shows a coating device with a multiple axis robot 58 which moves an application apparatus 59 along predefined coating agent paths over a component surface 60, wherein the robot 58 is operated by a robot controller 61 and can have a wrist. The robot controller 61 controls the robot 58 in such a way that the application apparatus 59 is guided along predefined coating agent paths over the component surface 60 wherein the coating agent paths lie adjacent to each other in a meandering pattern.

A feature is that an optical sensor 62 is also attached to the application apparatus 59 which during operation detects the position and course of the previous coating agent path so that the current coating agent path can be exactly aligned with regard to the previous coating agent path.

FIG. 13 shows in a very simplified form a variant of a coating device according to the invention with several, e.g., three, separate coating agent supply lines 63-65, which each supply one component of the coating agent to be applied.

On the output side the coating agent supply lines 63-65 are connected to a mixer 66 which mixes the individual components into a coating agent mixture which is then supplied to an application apparatus 67. Mixing of the various components of the coating agent thus takes place before application by the application apparatus 67. The component 3 shown in FIG. 13 is optional.

FIG. 14 shows a schematic view of an application apparatus 69 which applies an oscillation to the coating agent or a coherent coating agent jet 70'. The coating agent or a coherent coating agent jet 70' is discharged out of the coating agent nozzle 72 which breaks up between the coating agent nozzle 72 and the component surface 71 into droplets 70. The arrows F show schematically that the coating agent or the coating agent jet 70' is applied with the oscillation, frequency and/or instability at the coating agent nozzle 72 or by means of the carrier element comprising the coating agent nozzle 72.

Furthermore, the application apparatus 69 has at least one, and possibly a plurality, of cladding flow nozzles 73 which surround the coating agent nozzle 72 or a plurality of coating agent nozzles, for example in a ring-shaped manner, and discharge a ring-shaped cladding flow which surrounds the individual coating agent droplets 70.

On the one hand this serves to delimit the individual coating agent droplets 70 and to protect the discharged coating agent and/or the discharged coating agent droplets 70.

On the other hand the cladding flow discharged from the cladding flow nozzle 73 directs the coating agent droplets 70 in the direction of the component surface 71 and thereby improves the application efficiency.

In a similar way also one or more guide jet nozzles, in particular guide air nozzles, can be provided, the guide air from which is provided to protect the discharged coating agent and/or the discharged coating agent droplets or to form them and/or to guide them. Also, further function nozzles can be provided for discharge of certain media.

In a very simplified form FIG. 15 shows an application apparatus 74 during the application of two adjacent paint paths, wherein the position of the application apparatus 74 in the current paint path is shown without an apostrophe, while the position of the application apparatus 74' in the previous painting path is shown with an apostrophe.

The application apparatus 74 has a plurality of coating agent nozzles 75 arranged next to each other transversely to the path direction, wherein the outer section of application apparatus 74 discharges less coating agent than the inner section. As a result the application apparatus 74 achieves a trapezoidal layer thickness distribution 76 on the component surface. This is advantageous as the trapezoidal layer thickness distribution 76 is then superimposed on the also trapezoidal layer thickness distribution 76' of the previous paint path which leads to a constant layer thickness. FIGS. 20A and 21A show possible designs of a coating agent nozzle arrangement or a carrier element with coating agent nozzles (nozzle plate), in order to realize the principle of layer thickness distribution.

In a simplified form FIG. 16 shows a coating device according to the invention in which the components 77 to be coated are transported along linear conveyor path 78 through a painting cabin, which is known from the prior art and does not therefore need to be described in more detail.

A portal 79 spans the conveyor path 78 wherein attached to the portal are numerous application apparatuses 80 which are directed at the components 77 on the conveyor path 78 and coat these with a coating agent.

FIG. 17 shows a derivation of FIG. 10, so that to avoid repetition reference is made to the above description, wherein the same reference numerals being used for corresponding details.

A feature of this exemplary embodiment is the much greater packing density of the individual coating agent nozzles.

FIG. 18 shows a derivation of FIG. 17, so that to avoid repetition reference is made to the above description, wherein the same reference numerals being used for corresponding details.

Here too, the feature is that the packing density of the individual coating agent nozzles is much greater.

FIG. 19A shows a cylindrical nozzle form or a constant nozzle form.

Figure 19A:
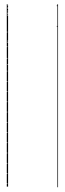
FIGS. 19A to 19E show various forms of longitudinal sections of coating agent nozzles. The longitudinal sections shown in FIGS. 19A to 19E can be round nozzles or slit nozzles.
Figure 19B:
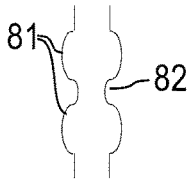

FIG. 19B shows an at least preferably twice widening and again narrowing nozzle form, in particular with at least two bulges 81 and at least one constriction 82, which is arranged between the at least two bulges 81, and preferably a constant or cylindrical inlet and a constant or cylindrical outlet.

Figure 19C:
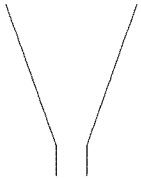

FIG. 19C shows a nozzle form with a conical tapering or narrowing inlet and cylindrical or constant outlet.

Figure 19D:
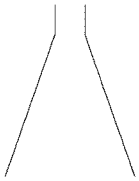

FIG. 19D shows a nozzle form with a cylindrical or constant inlet and a preferably conically widening outlet.

Figure 19E:
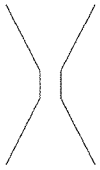

FIG. 19E shows a Venturi or Laval nozzle.

The cross sections of the nozzle forms shown in FIGS. 19A to 19E may be circular (e.g., round nozzles), but can also be rectangular (e.g., slit nozzles). With a constant nozzle form or constant inlet and/or outlet one means is an essentially unchanging cross section in the longitudinal direction of the coating agent nozzle.

The number and arrangement of the nozzles of the application apparatuses 8, 9 can be formed in such a way that the surfaces to be coated are coated uniformly, with fill coverage and homogeneously. To do this, the respective application apparatus 8, 9 can be fitted both with nozzles of one size and nozzle form but also with differently sized nozzles or different nozzle forms. The differently sized nozzles can be evenly distributed or grouped together in certain areas or forms. Through respective arrangement of the nozzles of an application apparatus 8, 9 it is possible to generate, for example, an ideal layer thickness distribution during the coating operation.

Figure 20A:
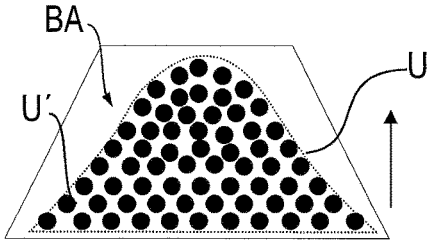

FIG. 20A shows a schematic representation of a coating agent nozzle arrangement BA which comprises a plurality of coating agent nozzles (shown schematically as black points). The coating agent nozzle arrangement BA is provided in such a way that a layer thickness distribution with an essentially Gaussian normal distribution is formed. The coating agent nozzle arrangement BA is, for example, provided in such a way that its coating agent nozzles form an outline U according to an essentially Gaussian normal distribution curve and are preferably distributed over the section U' (the surface under the Gaussian curve), which is surrounded by the outline U. Every further nozzle arrangement suitable for overlapping (e.g. a trapezoid or triangular form) can be generated. The arrow shown in FIG. 20A shows the direction of advance of the application apparatus 8.

Figure 20B:
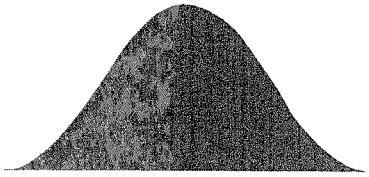

FIG. 20B shows a schematic representation of a cross-section through the layer thickness distribution, which is created by a coating agent nozzle arrangement BA according to FIG. 20A. The cross-section is limited to an essentially Gaussian normal distribution curve which essentially matches the outline U in FIG. 20A.

Figure 20C:
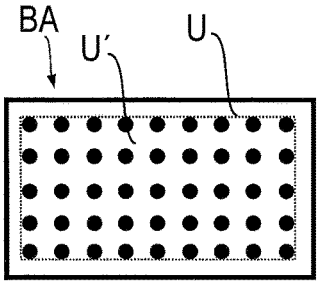

FIG. 20C shows a schematic representation of another coating agent nozzle arrangement BA which also comprises a plurality of coating agent nozzles (shown schematically as black points). The coating agent nozzles create a rectangular outline U and are preferably distributed over the section U' (rectangular surface), which is surrounded by the outline U, for example in a matrix-shaped manner. Such an arrangement is advantageous to allow sharp-edged coating.

Furthermore, a coating agent nozzle arrangement (not shown) is possible for which the coating agent nozzles create a circular outline and are distributed over a circular surface. There are also further arrangements possible.

Figure 21A:
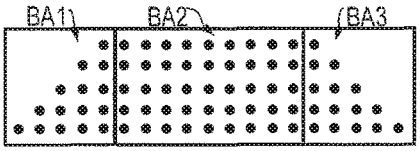

FIG. 21A shows a schematic representation of three coating agent nozzle arrangements BA1, BA2 and BA3 which are actuatable or adjustable independently of one another (for example controllable or variable). Each of the coating agent nozzle arrangements BA1, BA2 and BA3 has a plurality of coating agent nozzles (shown schematically as black points). The outer coating agent nozzle arrangement BA1 is provided in such a way that its coating agent nozzles create a triangular outline and may be distributed over the section which is surrounded by the triangular outline. The middle coating agent nozzle arrangement BA2 is provided in such a way that its coating agent nozzles create a rectangular outline and may be distributed over the section which is surrounded by the rectangular outline. The other outer coating agent nozzle arrangement BA3 is provided in such a way that its coating agent nozzles create a triangular outline and may be distributed over the section which is surrounded by the triangular outline. The three coating agent nozzle arrangements BA1, BA2 and BA3 are provided in such a way that their coating agent nozzles overall create a trapezoid outline. The middle coating agent nozzle arrangement BA2 is essentially provided for surface coating wherein the two outer coating agent nozzle arrangements BA1, BA3 are essentially provided for overlapping coating. The outer coating agent nozzle arrangements BA1, BA3 can also have every other nozzle distribution adapted for overlapping.

Figure 21B:
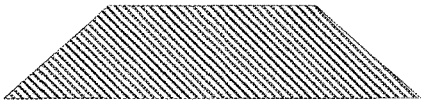

FIG. 21B is a schematic view of a cross-section through the layer thickness distribution which is created by the three coating agent nozzle arrangements BA1, BA2, BA3 according to FIG. 21A when all three coating agent nozzle arrangements BA1, BA2, BA3 apply. The cross-section of the layer thickness distribution is trapezoid.

Figure 1:
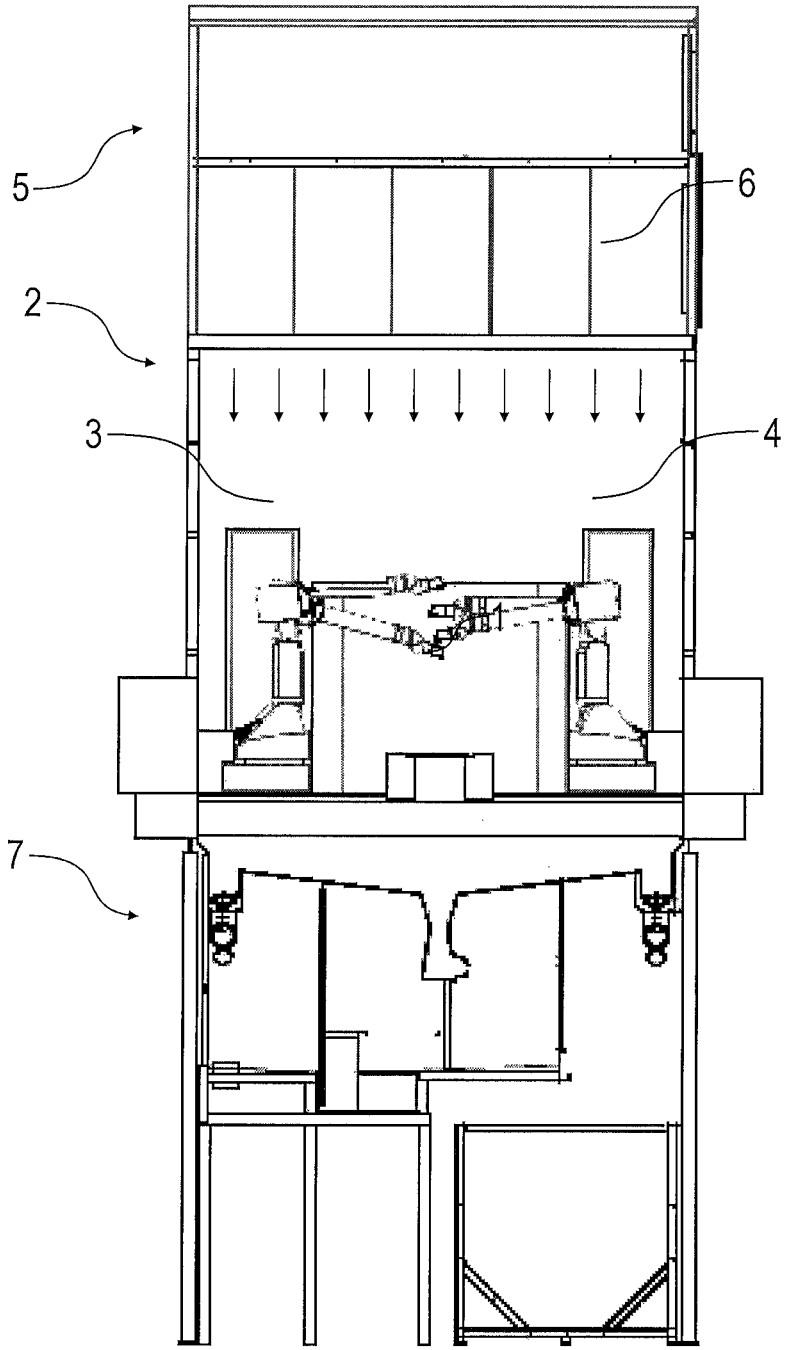
Fig. 1 Prior Art
Figure 2:
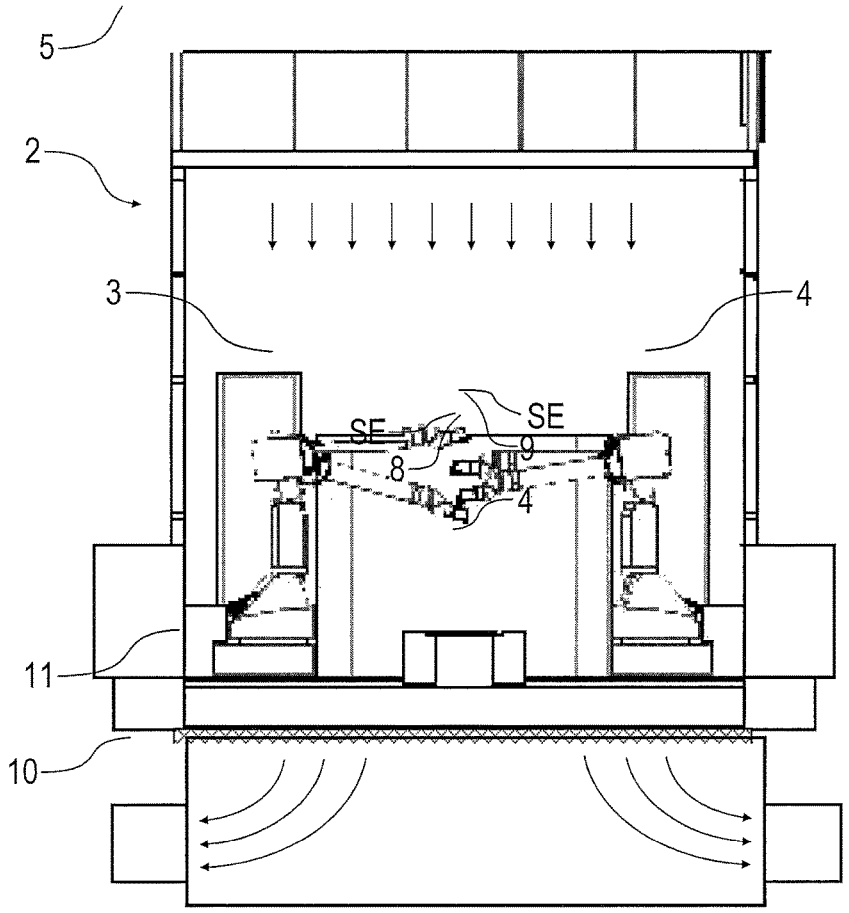
Figure 3A:
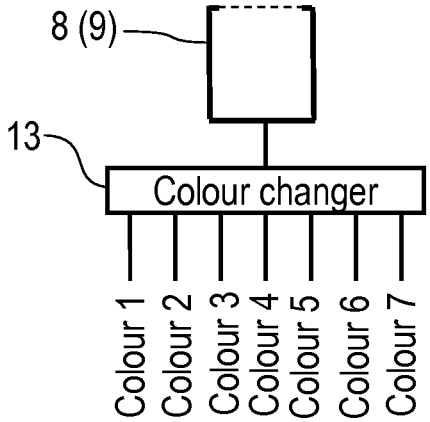
Figure 3B:
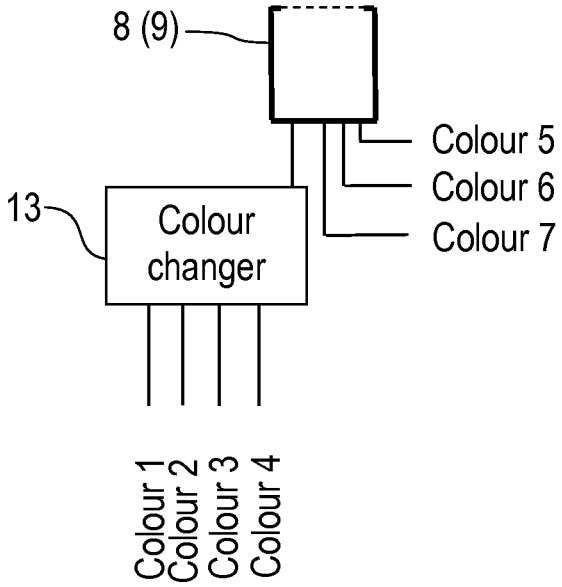
Figure 4A:
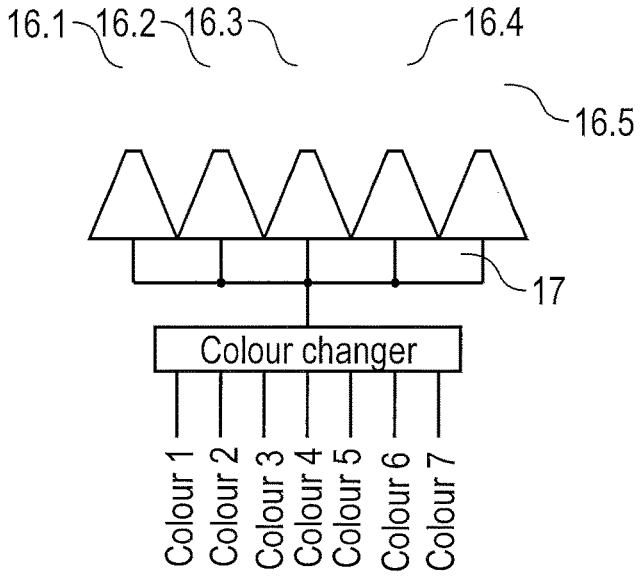
Figure 4B:
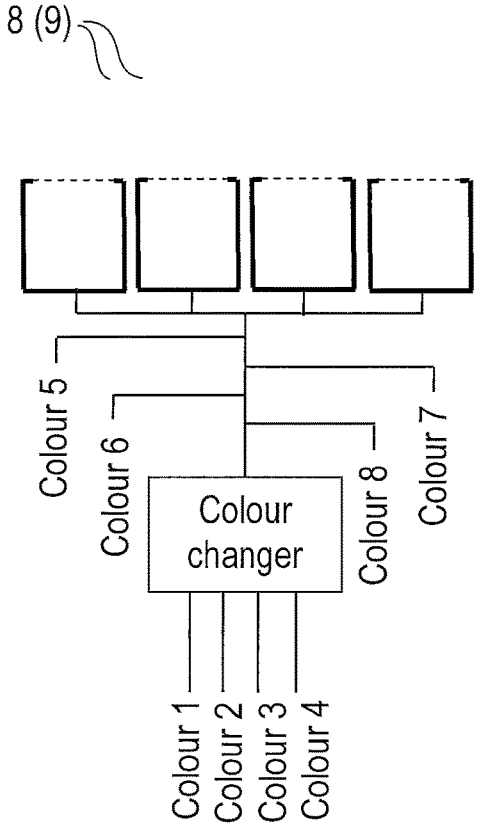
Figure 5:
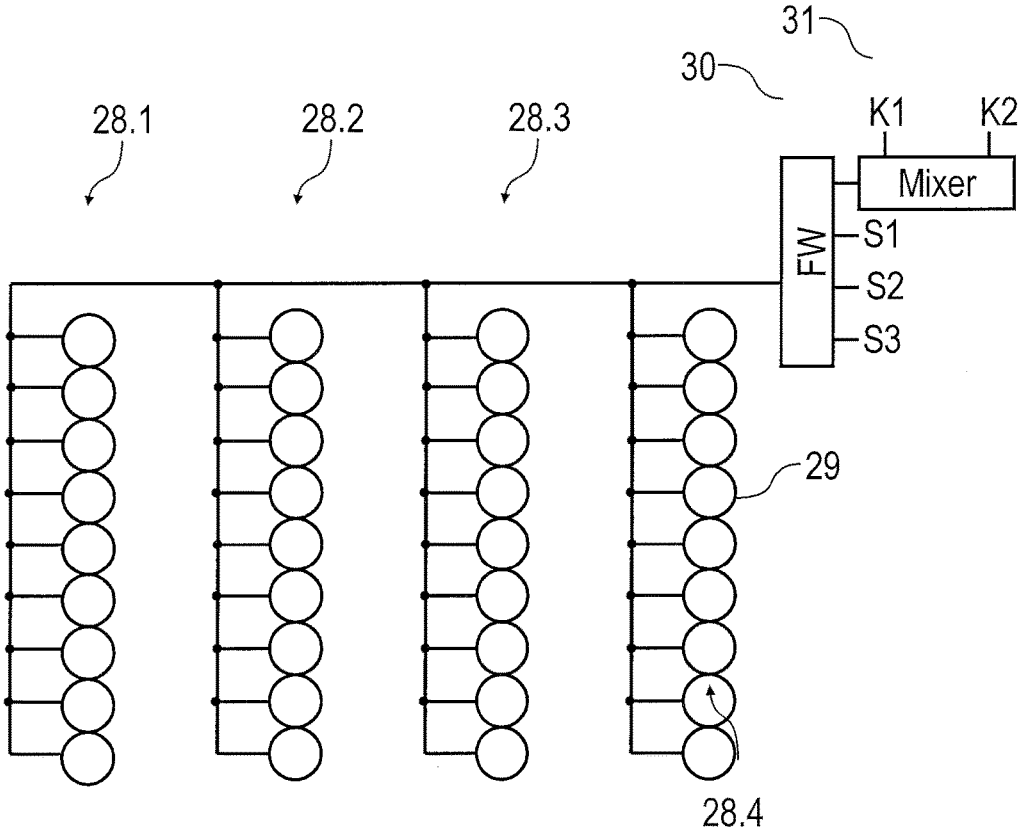
Figure 6:
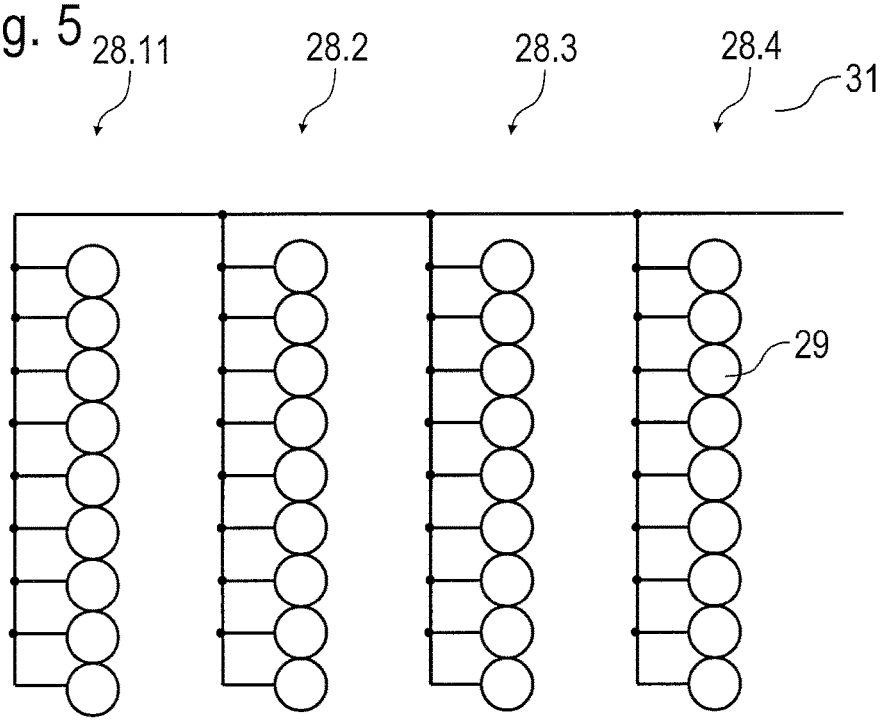
Figure 7:
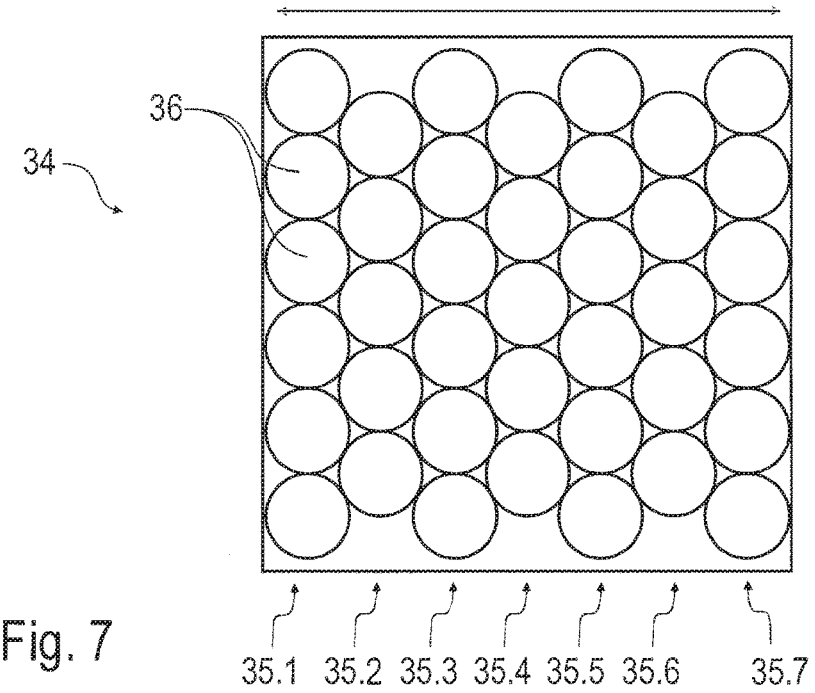
Figure 8:
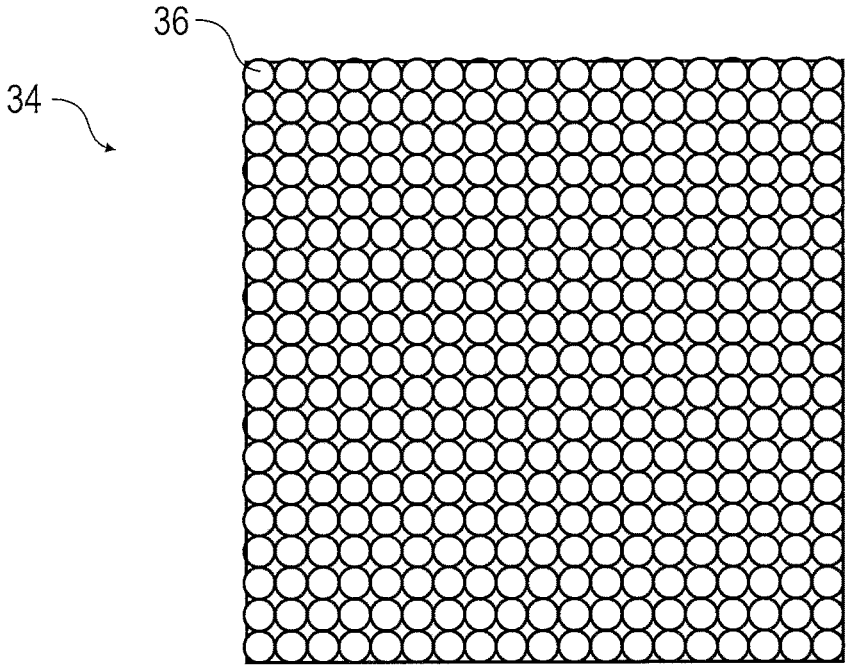
Figure 9:
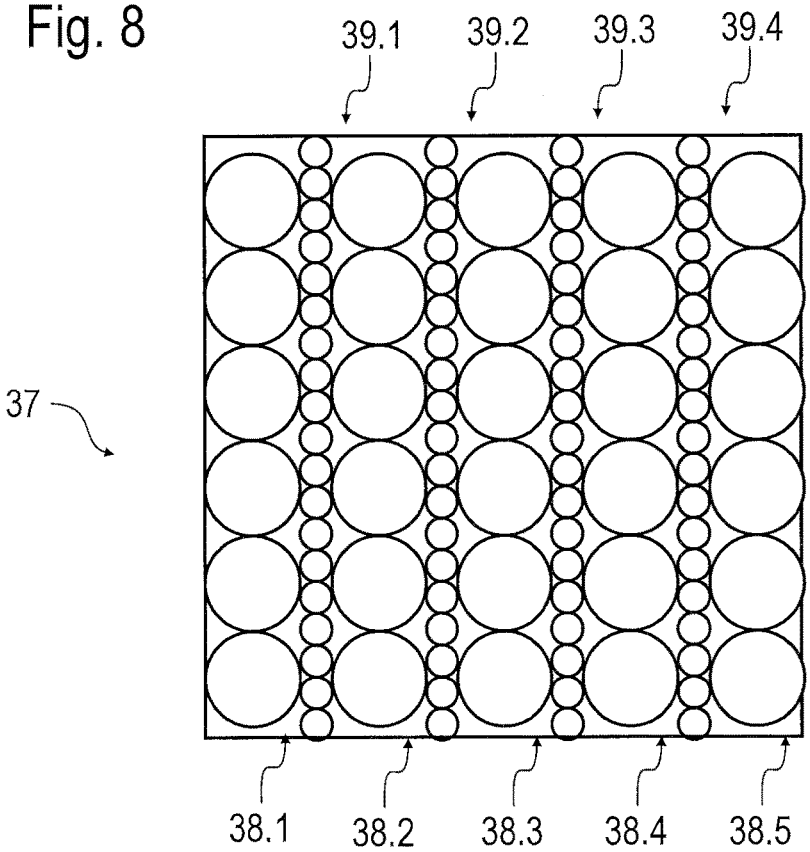
Figure 10:
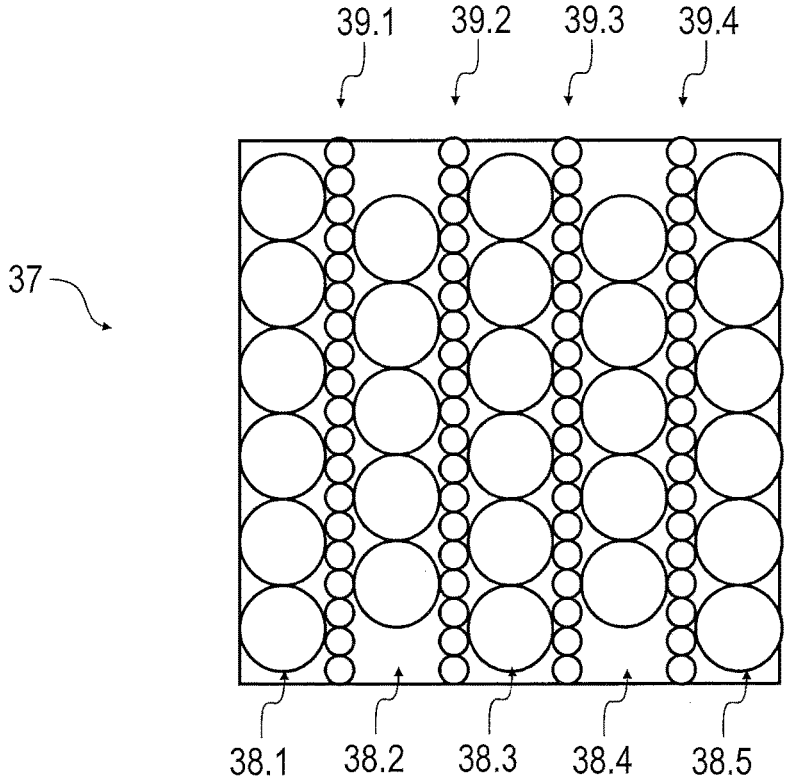
Figure 11:
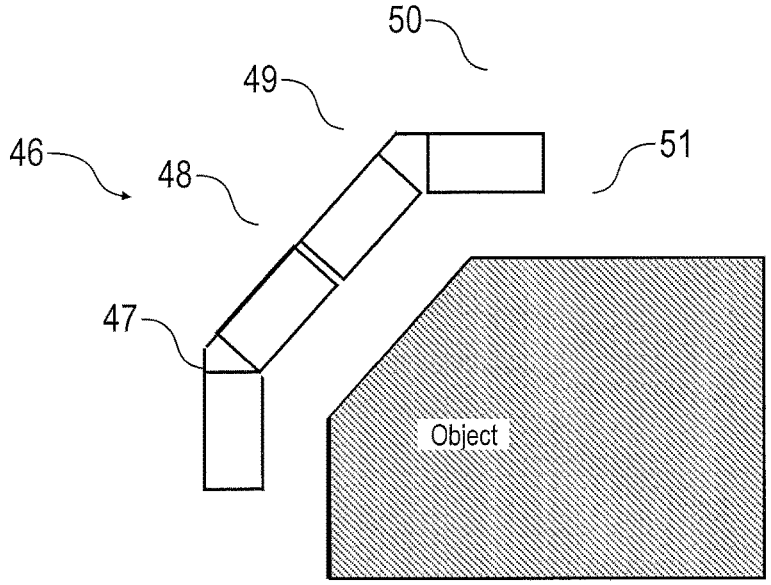
Figure 12:
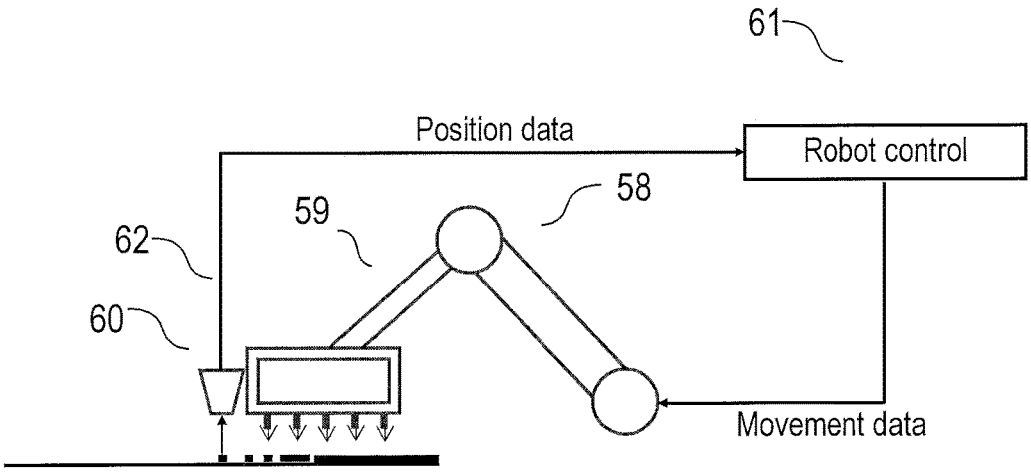
Figure 13:
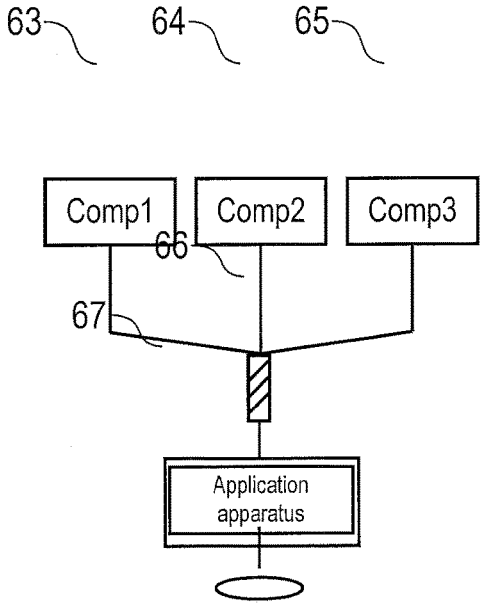
Figure 14:
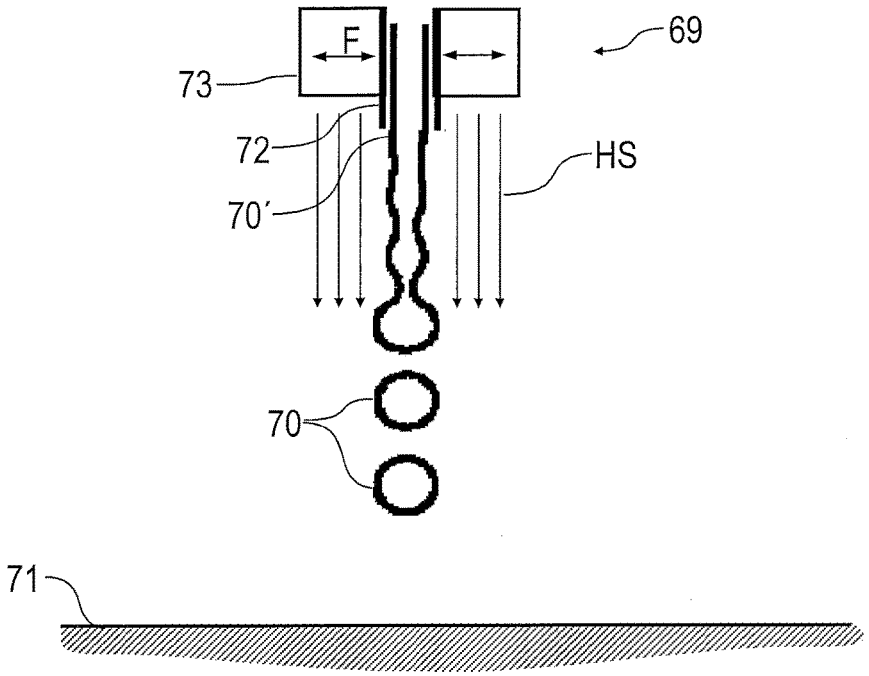
Figure 15:
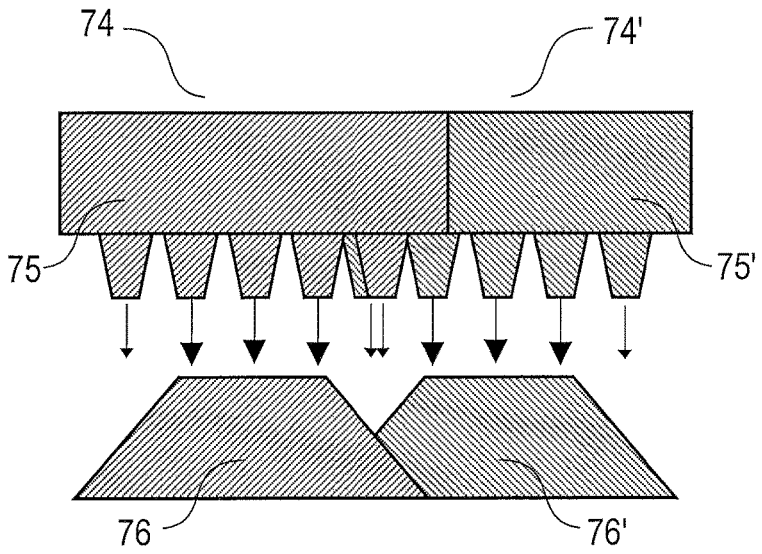
Figure 16:
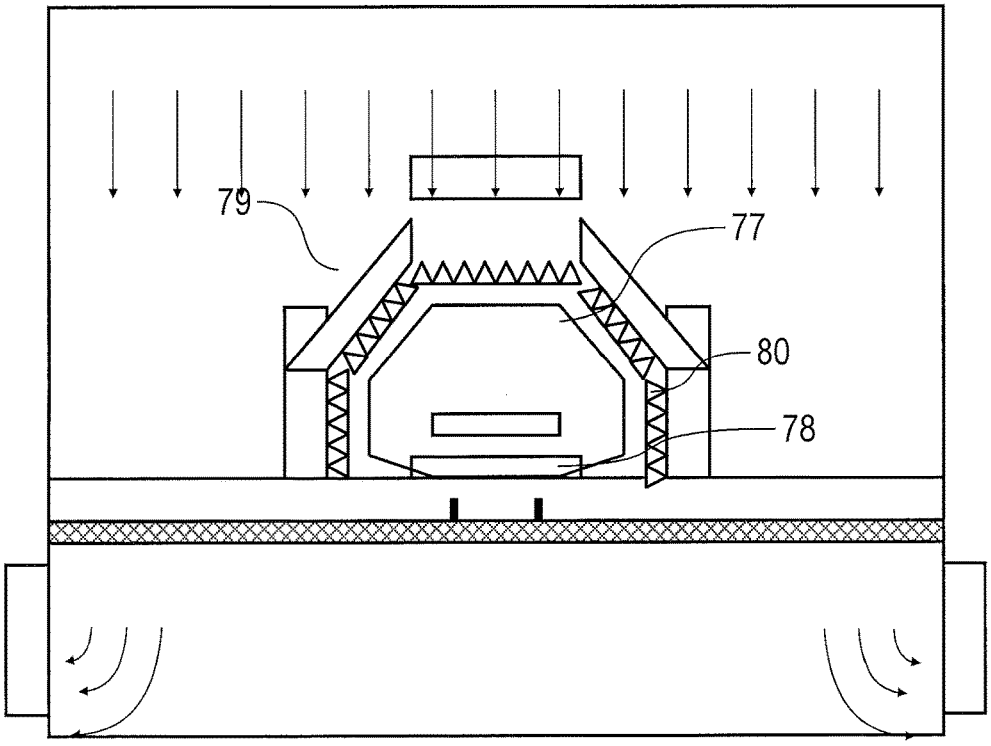
Figure 17:
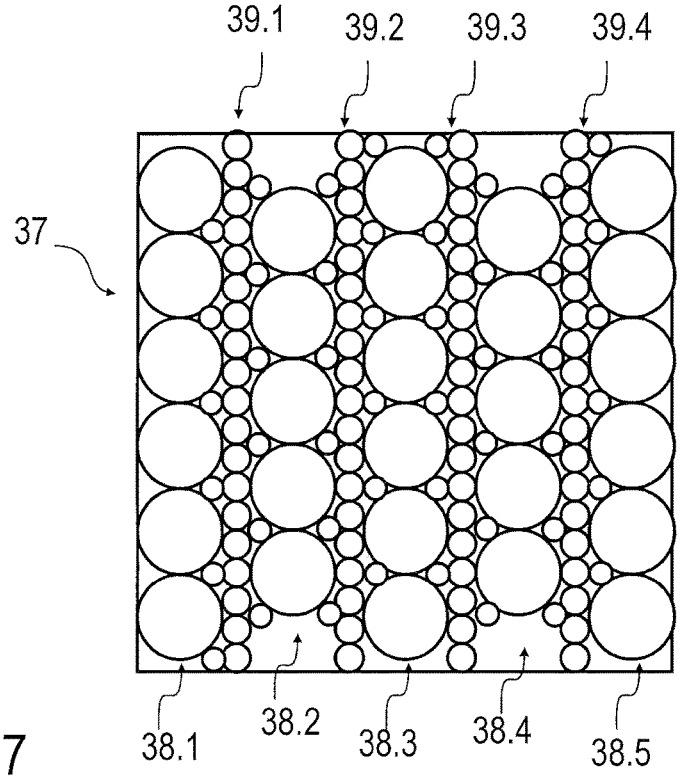
Figure 18:
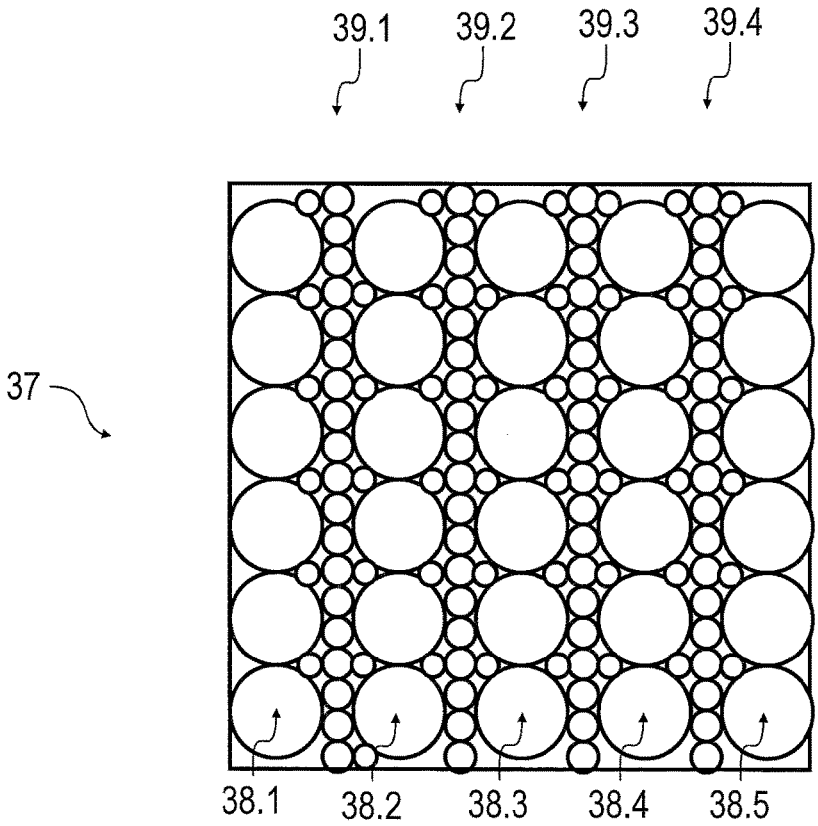
Figure 21C:
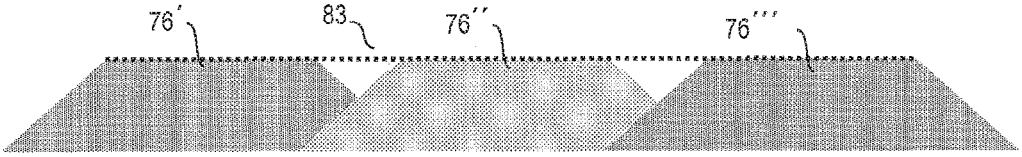

FIG. 21C, in a similar way to FIG. 15, shows three adjacing painting paths, each of which has a trapezoid layer thickness distribution 76', 76" and 76'". This is advantageous because the trapezoid layer thickness distributions can be overlapped appropriately which leads to and essentially constant layer thickness. The line marked with the reference numeral 83 shows the resulting layer thickness. As mentioned the trapezoid formation is only an exemplary formation and can be any other adapted distribution concerning overlapping.

Figure 21D:
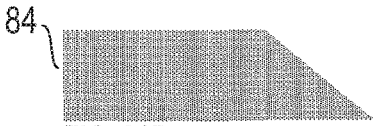

A further advantage with regard to the coating agent nozzle arrangements BA1, BA2 and BA3 shown in FIG. 21A is that particularly the outer coating agent nozzle arrangements BA1 and BA3 can be controlled, for example switched on and switched off. In this way it is possible, as shown in FIG. 21D, to achieve sharp-edged coating, as shown by the edge marked with the reference numeral 84. FIG. 21D shows a cross-section through a layer thickness distribution which is created by the middle coating agent nozzle arrangement BA2 and the outer coating agent nozzle arrangement BA3 shown in FIG. 21A on the right, wherein the coating agent nozzle arrangement BA1 shown in FIG. 21A on the left is switched off and therefore does not apply coating agent.

It is, however, also possible that an application apparatus "scans" on a "line" created by the individual nozzles along the surface to be coated or is moved during application of a line over the surface to be coated so that no overlappings are necessary.

Figure 22A:
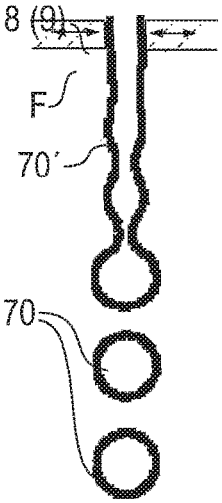

A break up into droplets is shown schematically in FIG. 22A. FIG. 22A shows a coherent coating agent jet 70' discharged from a coating agent nozzle of the application apparatus 8 (9) and, in particular, how the coherent, discharged coating agent jet 70' breaks up into droplets 70 due to the coupled in oscillation and/or instability, possibly based on the so-called "Rayleigh instability" or the so-called "Rayleigh disintegration". The application apparatus 8 (9) applies droplets 70, essentially equal in size, wherein an essentially discrete or essentially homogeneous droplet distribution is achieved, as one can see in FIG. 22A. The arrows F show schematically that the coating agent or the coating agent jet 70' is, at the coating agent nozzle or by means of the carrier element comprising the coating agent nozzle, applied with the oscillation, frequency and/or instability.

Figure 22B:
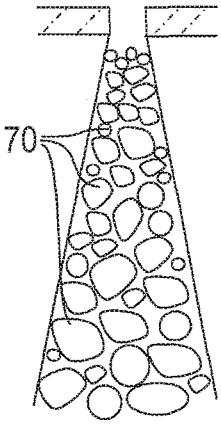
Figure 22C:
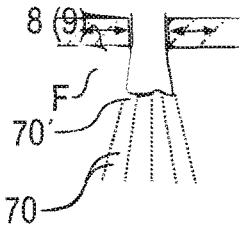

Another possible droplet break up is shown in a very simplified form in FIG. 22C. FIG. 22C shows a coherent essentially flat coating agent jet discharged from a coating agent nozzle of the application apparatus 8 (9) (for example a coating agent sheet or a coating agent lamella; for simplicity this is also given the reference numeral 70'), which breaks up into droplets due to the coupled in oscillation and/or instability (for simplicity also given the reference numeral 70).

The flat coherent coating agent jet 70' breaks up into a plurality of droplet producing (essentially one-dimensional) coating agent jets. Also the arrows F in FIG. 22C show schematically that the coating agent or the coating agent jet 70' is, at the coating agent nozzle or by means of the carrier element comprising the coating agent nozzle, applied with the oscillation, frequency and/or instability.

FIG. 22B, on the other hand, shows a schematic atomization of coating agent according to the prior art. One can recognize the different sized coating agent droplets (for simplicity also given the reference numeral 70) and the non-homogeneous droplet distribution which contributes to an increased overspray.

The structure, the principle and/or the functionality of such droplet generators is, for example, known from DE 44 41 553 C2, DE 10 2006 012 389 A1 and the publications "Atomization and Sprays, vol. 7, pp. 43-75, 1997, "METHODS AND TOOLS FOR ADVANCED FUEL SPRAY PRODUCTION AND INVESTIGATION", G. Brenn, F. Durst, D. Trimis, and M. Weclas" and "Atomization and Sprays, vol. 15, pp. 661-685, 2005, "CONTROL OF SPRAY FORMATION BY VIBRATIONAL EXCITATION OF FLAT-FAN AND CONICAL LIQUID SHEETS", Günter Brenn, Zeljiko Prebeg and Dirk Rensink, Alexander L. Yarin", the disclosures of which should be added in full to this disclosure, and accordingly are hereby incorporated by reference herein in their entireties.

Figure 28:
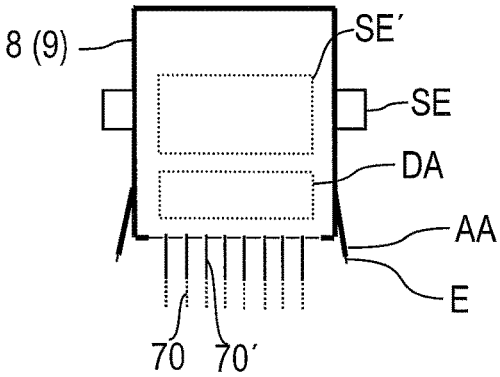

It is possible that the respective oscillation generator SE couples the oscillation and/or the instability preferably via the housing of the application apparatus 8 (9) into the coating agent. For this purpose the oscillation generator SE can, for example, be arranged as a quartz oscillator on the outside of the respective housing of the application apparatuses 8, 9 or at least provided in order to apply oscillation to this section, which is shown in FIG. 28 in a very simplified form. It is, however, possible, as an alternative or additionally, that the oscillation generator is integrated into the inner side of the respective application apparatus 8, 9 and applies the coating agent with the oscillation and/or the instability, for example, by sound, mechanically by means of physical contacting or by means of a piezo element, in order to allow droplets to form, which is shown in FIG. 28 in a very simplified form by the dashed lined rectangle marked with SE'.

The coherent or continuous coating agent jet which should break up into droplets can be made available in a number of ways. FIGS. 23A to 23E schematically show various coating agent jets (for simplicity all also given the reference numeral 70'), which are discharged from a coating agent nozzle (not shown in FIGS. 23A to 23E), and respective spray jet cross-sections 70".

Figure 23A:
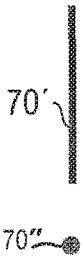

FIG. 23A shows an (essentially one-dimensional) full jet which can be influenced according to the invention so that it breaks up into droplets.

Figure 23B:
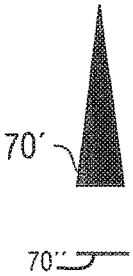

FIG. 23B shows an essentially planar jet (for example a coating agent sheet or a coating agent lamella) in the form of a flat and/or a layered jet or a triangular jet, which can be influenced according to the invention so that it breaks up into droplets and/or it breaks up into a plurality of coating agent jets (preferably essentially one-dimensional) which break up into droplets.

Figure 23C:
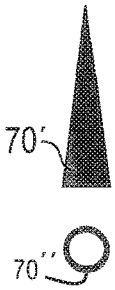
Figure 23D:
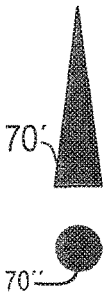
Figure 23E:
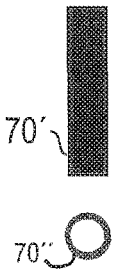

FIG. 23C shows a hollow-cone jet, FIG. 23D a full-cone jet and FIG. 23E a hollow-cylindrical jet, which also can be influenced according to the invention so that they break up into droplets and/or they break up into a plurality of coating agent jets (possibly essentially one-dimensional) which break up into droplets.

It is also possible not only to generate circular but also essentially rectangular spray jet cross-sections.

Figure 24A:
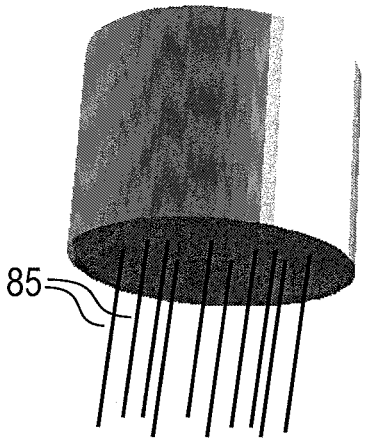
Figure 24B:
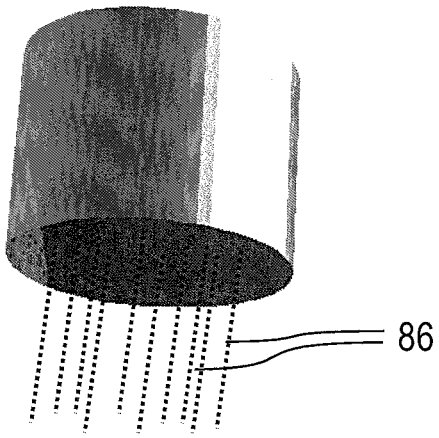

FIGS. 24A and 24B each show an application apparatus 8 (9) in a very simplified form. Each application apparatus 8 (9) has a plurality of coating agent nozzles in one level.

Figure 25A:
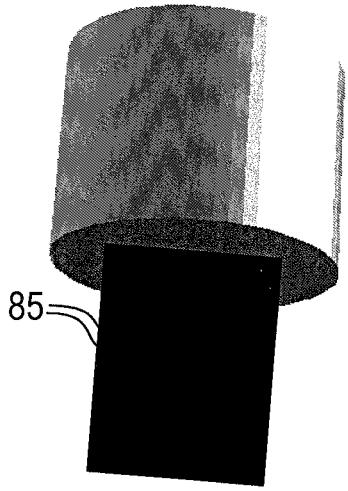
Figure 25B:
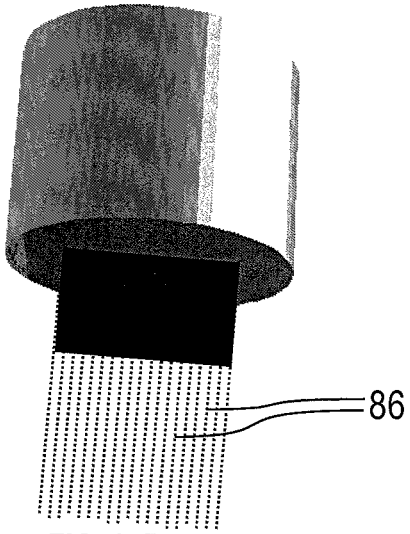

FIGS. 25A and 25B each show another application apparatus 8 (9) in a very simplified form. Each application apparatus 8 (9) has a gap or slit nozzle.

Figure 26A:
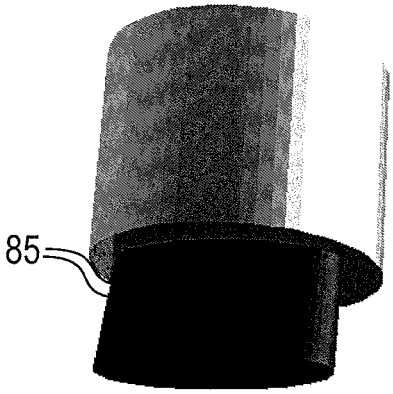
Figure 26B:
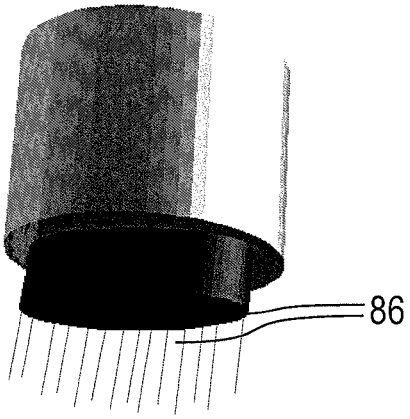

FIGS. 26A and 26B each show yet another application apparatus 8 (9) in a very simplified form. Each application apparatus 8 (9) has a circular or conical nozzle.

For the application apparatuses shown in FIGS. 24A, 25A and 26A there is no application of an oscillation and/or an instability to the coating agent or coating agent jet 85 which is why the coating agent jets 85 do not break up into droplets.

For the application apparatuses shown in FIGS. 24B, 25B and 26B there is, on the other hand, application of an oscillation and/or an instability to the coating agent or coating agent jet 86 which is why the coating agent jets 86 break up into droplets. In FIG. 25B and FIG. 26B there should actually be significantly more droplet jets 86 displayed, which were, however, ignored because they would have no longer been recognizable.

Figure 27A:
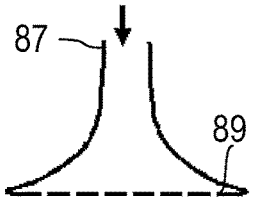
Figure 27B:
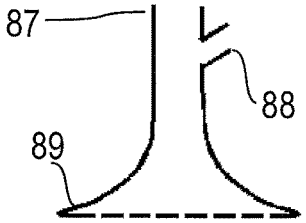
Figure 27C:
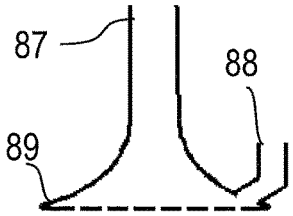

FIGS. 27A, 27B and 27C show schematic views of cross-sections of various application apparatuses, in particular in the area of a carrier element for a nozzle plate and/or a plurality of coating agent nozzles. A carrier element 89 and a coating agent supply 87 which opens out into the carrier element 89 can particularly be seen. The coating agent supply 87 preferably widens in the direction of flow of the coating agent (see arrow in FIG. 27A) or towards at least one coating agent nozzle, in order to supply one or more coating agent nozzles with coating agent.

The application apparatus can have at least one degassing outlet pipe and/or a return line connection or a degassing opening 88 as shown in FIGS. 27B and 27C. The degassing outlet pipe or the return line connection 88 in FIG. 27B is arranged on the coating agent supply 87 or at least adjacent to this, whereas in FIG. 27C the degassing outlet pipe or the return line connection 88 can be arranged adjacent to the coating agent nozzles, adjacent to the carrier element or on the carrier element.

FIG. 28, which was already mentioned above, shows the application apparatus 8 (9) which generates a plurality of initially coherent coating agent jets 70', which break up into droplets 70 due to the oscillation and/or the instability generated by the oscillation generator SE or SE'. Furthermore, the application apparatus 8 shown in FIG. 28 comprises a system for electrostatic coating agent charging with a high voltage, e.g., an electrostatic coating agent charging system for external charging AA of the (discharged) coating agent. The coating agent charging system AA can comprise a plurality of finger electrodes or an electrode ring, in which a multiplicity of electrodes is embedded. The finger electrodes, the electrode ring and/or the electrodes E are preferably arranged outside the application apparatus housing 8, wherein, in particular, the electrodes E are evenly spaced around the application apparatus 8 in order to charge the coating agent discharged from the at least one coating agent nozzle.

It is also possible that an electrostatic coating agent charging system for direct charging DA of the (not yet discharged) coating agent is provided, which is indicated in FIG. 28 by the dotted line rectangular marked with the reference numeral DA. In doing so the coating agent, which was not yet discharged, passes by at least one electrode integrated on the inside of the application apparatus 8, to be charged. The coating agent charging system AA, DA is configured and arranged in order to achieve an improved separation, an improved coating agent yield and/or an improved application efficiency.

Figure 29:
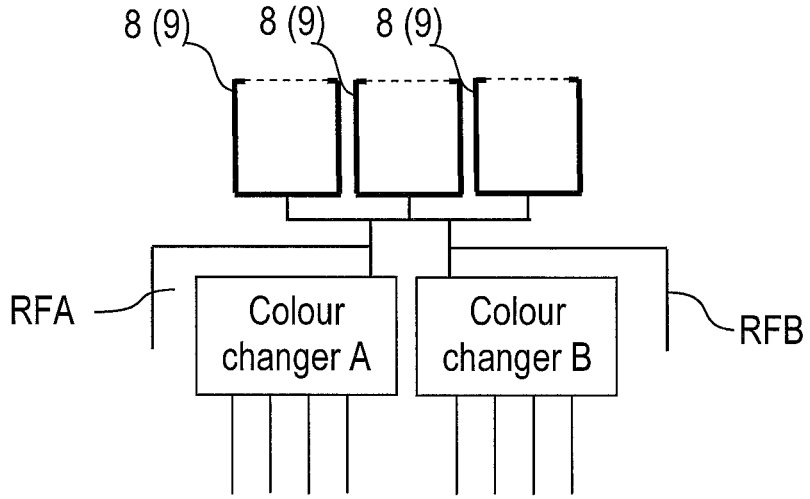

FIG. 29 shows a plurality of, e.g., three, application apparatuses 8 with a plurality of, e.g., two, coating agent supply lines, completely separated from each other, each with its respective colour changer A, B, so that while the one colour changer or the one coating agent supply line leads the coating agent to the application apparatuses 8, the other colour changer or the other coating agent supply line can be prepared. It is therefore applied either via the first colour changer A or via the second colour changer B. A return line RFA, RFB can respectively be attached to the coating agent supply lines between the application apparatuses 8 and the respective colour changer A, B.

Figure 30:
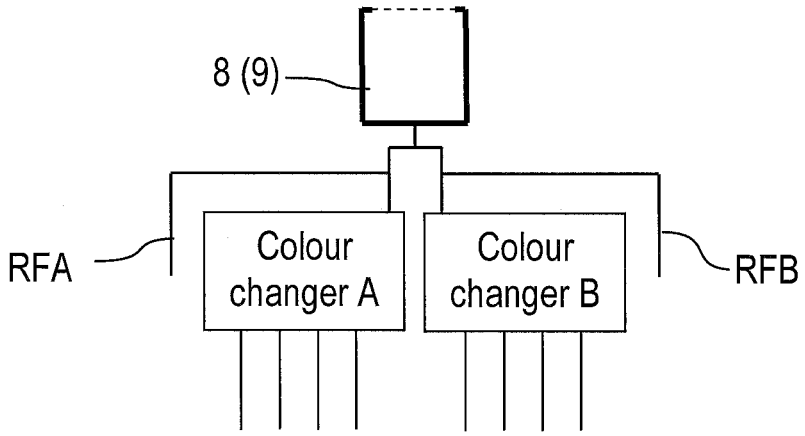

FIG. 30 shows an application apparatus 8 with two coating agent supply lines, completely separated from each other, each with its respective colour changer A, B, so that while the one colour changer or the one coating agent supply line leads the coating agent to the application apparatuses 8, the other colour changer or the other coating agent supply line can be prepared. A return line RFA, RFB can respectively be attached to the coating agent supply lines between the application apparatus 8 and the respective colour changer A, B. Also here it is applied either via the first colour changer A or via the second colour changer B.

Figure 31:
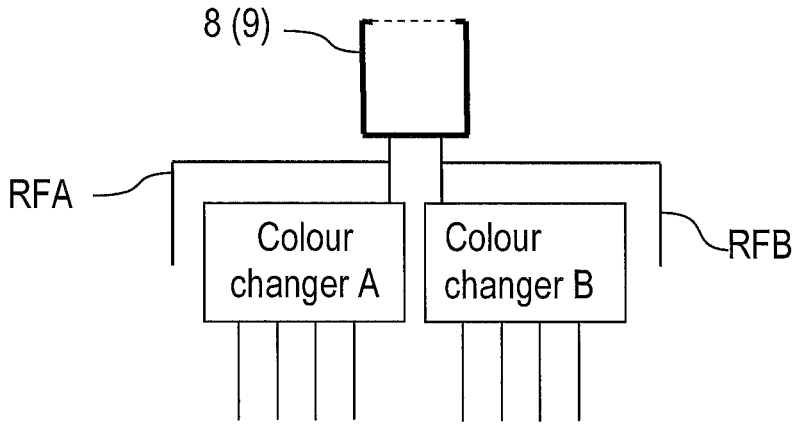

FIG. 31 shows an application apparatus 8 with two separated coating agent supply lines and an integrated switch-over device to set which of the multiplicity of coating agent supply lines and/or which of the multiplicity of colour changers A, B the coating agent will be discharged from. The two coating agent supply lines are completely separated from each other, open out into the application apparatus 8 and each has a colour changer A, B. In a similar way to the exemplary embodiments according to FIGS. 29 and 30, also here it is possible to provide return lines RFA, RFB between the respective colour changer A, B and the application apparatus 8, wherein also here it is applied either via the first colour changer A or via the second colour changer B.

The above-mentioned preferred exemplary embodiments can be combined with each other. The invention is not limited to the exemplary embodiments described above. Instead, a plurality of variants and modifications are possible, which also make use of the concept of the invention and thus fall within the scope of protection.

The invention claimed is:

1. A coating device for coating a component with a coating agent, the device comprising:

an application apparatus including at least one nozzle arrangement having a plurality of nozzles configured in a row to discharge the coating agent onto the component, wherein the application apparatus is configured to apply an oscillation to the coating agent, and the nozzle arrangement discharges the coating agent to a thickness distribution consisting of a Gaussian distribution, and a trapezoidal distribution.

2. The coating device of claim 1, wherein the plurality of nozzles each discharge the coating agent in the form of a coherent coating agent jet and the coating agent jet is broken up into droplets between a coating agent nozzle and the component.

3. The coating device of claim 1, wherein at least one nozzle is selected from the group consisting essentially of an essentially one-dimensional jet, an essentially planar jet, a liquid sheet, and a hollow cylindrical jet.

4. The coating device of claim 1, wherein the application apparatus is attached on an input side to a mixer.

5. The coating device of claim 2, wherein the application apparatus comprises an oscillation generator that is configured to apply an oscillation to at least one of the coating agent and the nozzle; and further wherein the oscillation generator is provided to apply the oscillation to at least one of the coating agent and the nozzle via one of a housing of the application apparatus.

6. The coating device of claim 1, wherein the oscillation is generatable by means of a piezo element.

7. The coating device of claim 1, wherein the application apparatus is provided to generate at least one of droplets which are essentially of a same diameter; and a defined mixture of certain droplet sizes.

8. The coating device of claim 1, wherein at least one of a coating agent pressure and a dosing pressure with which the coating agent is fed to the application apparatus is controllable.

9. The coating device of claim 1, wherein at least one of the following parameters is adjustable: a discharge speed of the coating agent, an amplitude of the oscillation, and a frequency of the oscillation.

10. The coating device of claim 1, wherein the coating device comprises at least one of the following components and the application apparatus is operatively connectable to at least one of the following components: at least one dosing device, at least one color changer, and at least one mixer for two or multi-component paints or different coating agents.

11. The coating device of claim 1, wherein the application apparatus has at least one of: a cladding flow nozzle which is configured to discharge a cladding flow comprising air or another gas with which discharged coating agent can be cladded, and a guiding air flow nozzle which is configured to discharge a guiding air flow comprising air or another gas with which discharged coating agent can be influenced.

12. The coating device of claim 1, wherein the coating nozzles of various nozzle arrangements are commonly connected to a coating agent supply line via which the coating agent to be applied can be supplied, and the coating agent supply line can be supplied by at least one of a color changer and a mixer.

13. The coating device of claim 1, wherein the application apparatus is configured to be supplied by a plurality of separated coating agent feed lines that are each assigned to at least one of a color changer and a dosing device; and the apparatus comprises an integrated changeover module that sets from which of the plurality of coating agent feed lines, the coating agent is delivered.

14. The coating device of claim 1, further comprising an electrostatic coating agent charging system.

15. The coating device of claim 1, wherein at least one coating agent nozzle is conically tapering with a cylindrical outlet.

16. The coating device of claim 1, wherein the application apparatus comprises at least one return line for at least one of the coating agent, a pulsed air, and a flushing/cleaning agent.

17. The coating device of claim 1, wherein at least one nozzle includes a degassing opening.

* * * * *